US008351625B2

(12) United States Patent
Kasai

(10) Patent No.: US 8,351,625 B2
(45) Date of Patent: Jan. 8, 2013

(54) ACOUSTIC SENSOR AND MICROPHONE

(75) Inventor: Takashi Kasai, Kusatsu (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 13/318,261

(22) PCT Filed: Mar. 16, 2011

(86) PCT No.: PCT/JP2011/056248

§ 371 (c)(1),
(2), (4) Date: Feb. 15, 2012

(87) PCT Pub. No.: WO2012/114535

PCT Pub. Date: Aug. 30, 2012

(65) Prior Publication Data

US 2012/0213400 A1 Aug. 23, 2012

(30) Foreign Application Priority Data

Feb. 23, 2011 (JP) ..... 2011-036903

(51) Int. Cl.
*H04R 25/00* (2006.01)

(52) U.S. Cl. ..... 381/175; 381/176; 381/178

(58) Field of Classification Search ..... 381/175, 381/176, 178, 191, 355, 398, 399, 423; 310/311, 310/322, 325; 57/416; 257/415, 419
See application file for complete search history.

(56) References Cited

U.S. PATENT DOCUMENTS

| | | | | |
|---|---|---|---|---|
| 2007/0047746 | A1 | 3/2007 | Weigold et al. | |
| 2009/0016550 | A1 * | 1/2009 | Qiao | 381/175 |
| 2010/0155864 | A1 * | 6/2010 | Laming et al. | 257/416 |
| 2010/0158280 | A1 * | 6/2010 | Coronato et al. | 381/174 |

FOREIGN PATENT DOCUMENTS

| | | | |
|---|---|---|---|
| JP | 62-213400 | A | 9/1987 |
| JP | 2005-110204 | A | 4/2005 |
| JP | 2008-005439 | A | 1/2008 |
| JP | 2008-005439 | A | 10/2008 |
| JP | 2009-124474 | A | 6/2009 |
| JP | 2010-056745 | A | 3/2010 |

* cited by examiner

*Primary Examiner* — Fan Tsang
*Assistant Examiner* — Eugene Zhao
(74) *Attorney, Agent, or Firm* — Nutter McClennen & Fish LLP; John J. Penny, V.

(57) ABSTRACT

Provided is an acoustic sensor capable of improving an S/N ratio of a sensor without preventing reduction in size of the sensor. A back chamber 45 is vertically opened in a silicon substrate 42. A thin film-like diaphragm 43 to serve as a movable electrode plate is formed on the top surface of the substrate 42 so as to cover the back chamber 45. The back plate 48 is fixed to the top surface of the substrate 42 so as to cover the diaphragm 43, and a fixed electrode plate 49 is provided on the under surface of the back plate 48. Further, the diaphragm 43 is divided into a plurality of areas by the slit 47, and the respective plurally divided diaphragms 43*a*, 43*b* and the fixed electrode plate 49 constitute a plurality of parallelly connected capacitors (acoustic sensing sections 60*a*, 60*b*).

12 Claims, 25 Drawing Sheets

(A)

(B)

ACOUSTIC SENSOR AND MICROPHONE

TECHNICAL FIELD

The present invention relates to an acoustic sensor and a microphone. Specifically, the present invention relates to an acoustic sensor of a capacitance type, manufactured by means of a MEMS (Micro Electro Mechanical System) technique or micromachining technique. Further, the present invention relates to a microphone using the acoustic sensor.

BACKGROUND ART

There have been used microphones in a variety of equipment such as mobile phones and IC recorders. An acoustic sensor built in each of such microphones is required to have an improved S/N ratio and a reduced size.

As a method for increasing an S/N ratio of the acoustic sensor, first, there is a method of increasing sensitivity of the acoustic sensor. In order to increase the sensitivity of the acoustic sensor of the capacitance type, there can be adopted a method of widening an area of a diaphragm and a method of reducing spring properties of the diaphragm to increase a displacement amount of the diaphragm. However, in the former method of widening the area of the diaphragm, reduction in size of the acoustic sensor is hindered. Further, in such a method of decreasing the spring properties of the diaphragm as the latter method, since the displacement amount of the diaphragm increases, durability of the acoustic sensor decreases.

A second method for increasing the S/N ratio of the acoustic sensor is to reduce noise of the acoustic sensor. As the noise of the acoustic sensor of the capacitance type, thermal noise generated in an air gap formed between the diaphragm (movable electrode plate) and a back plate (fixed electrode plate) are problematical.

The thermal noise in the air gap is noise generated by a mechanism shown in FIG. 1(A). As shown in FIG. 1(A), air molecules α present inside an air gap 13 between a diaphragm 11 and a back plate 12, namely a semi-enclosed space, are collided with the diaphragm 11 due to fluctuations (thermal motion). Microforce due to the collision with the air molecules α is applied to the diaphragm 11, and the microforce applied to the diaphragm 11 fluctuates at random. Therefore, the diaphragm 11 vibrates due to the collision with the air molecules α, to generate electric noise in a vibration sensor. Especially in a highly sensitive acoustic sensor or microphone, noise attributed to such thermal noise is large, and the S/N ratio thus deteriorates.

The noise attributed to such thermal noise is alleviated by increasing an opening ratio of an acoustic hole 14 opened in the back plate 12 as shown in FIG. 1(B), to facilitate passage of air inside the air gap 13 through the acoustic hole 14. Further, the noise is also alleviated by widening the air gap 13 between the diaphragm 11 and the back plate 12. However, when the opening ratio of the acoustic hole 14 is increased or the air gap 13 is widened, a capacitance of a capacitor configured by the diaphragm 11 and the back plate 12 decreases. For this reason, with the method of simply reducing noise, the sensitivity of the acoustic sensor decreases simultaneously with reduction in noise, and hence it has not been possible to improve the S/N ratio of the acoustic sensor.

(Conventionally Known Vibration Sensor)

Patent Document 1 discloses a microphone of a difference sensing system aimed at improving the S/N ratio. In this microphone 21, as shown in FIG. 2, two acoustic sensors 23*a*, 23*b* are provided on one substrate 22, and vertical configurations of both sensors 23*a*, 23*b* are inverted to each other. That is, in one acoustic sensor 23*a*, a fixed plate 25*a* having acoustic holes 26*a* is formed above a diaphragm 24*a*, to constitute a capacitor for acoustic sensing. In the other acoustic sensor 23*b*, a diaphragm 24*b* is formed above a fixed plate 25*b* having acoustic holes 26*b*, to constitute a capacitor for acoustic sensing.

With sensing signals outputted from the diaphragms 24*a*, 24*b* in the acoustic sensors 23*a*, 23*b*, when both acoustic sensors 23*a*, 23*b* detect the same acoustic vibration, sensing signals with phases displaced 180° are outputted from both sensors 23*a*, 23*b*. The output of the acoustic sensor 23*a* and the output of the acoustic sensor 23*b* are inputted into a signal processing circuit (ASIC), and subjected to subtraction processing inside the signal processing circuit. This results in adding up of the acoustic detection signals detected by both sensors 23*a*, 23*b*, whereby the detection sensitivity of the microphone 21 improves, and the S/N ratio is expected to improve.

In such a microphone of the difference sensing system, the detection sensitivity thereof decreases unless phases, frequencies and sensitivities of acoustic detection signals detected by the two acoustic sensors are completely the same. However, making characteristics of the acoustic sensors, separately formed on the same substrate, identical is difficult. Further, when polarities of the capacitors in both sensors 23*a*, 23*b* are opposite to each other as in this microphone, producing two equivalent acoustic sensors 23*a*, 23*b* is difficult due to a parasitic capacitance. It has thus been difficult in practice to improve the S/N ratio in such a microphone as in Patent Document 2.

Further, in such a microphone, noise derived from mismatching tends to be generated, and hence there are limitations on improvement in S/N ratio.

Moreover, an extra computing function needs to be added to the signal processing circuit, which results in high cost of the signal processing circuit. There has also been a problem in that reduction in size of the microphone is difficult because of the need to provide a plurality of acoustic sensors on the substrate.

(Another Conventionally Known Vibration Sensor)

Patent Document 2 discloses another conventional microphone. This microphone 31 basically has a similar structure to that of the microphone 21 of Patent Document 1. In the microphone 31 of Patent Document 2, as shown in FIG. 3(A), a plurality of independent acoustic sensors 33*a*, 33*b*, . . . having the same structure are provided on a common substrate 32. That is, any of the acoustic sensors 33*a*, 33*b*, . . . is formed with a diaphragm 34 as opposed to the top surface of a fixed plate 35 in which acoustic holes 36 are opened. Further, as shown in FIG. 3(B), a signal processing circuit 37 is provided on the top surface of the substrate 32, and an output of each of the acoustic sensors 33*a*, 33*b*, . . . is connected to the signal processing circuit 37 through an electrode leader 38 wired on the substrate 32. In the case of this microphone 31, with each of the acoustic sensors 33*a*, 33*b*, . . . having the same structure, the output of each of the acoustic sensors 33*a*, 33*b*, . . . is subjected to addition processing in the signal processing circuit 37 so that the improvement in S/N ratio is expected.

However, even the microphone described in Patent Document 2 has a problem as follows. Since warpage that occurs in the diaphragm in the microphone producing process varies, variations in sensitivity among each acoustic sensor tend to be large. On the other hand, when the variations are intended to be made smaller, the productivity of the microphone decreases. Further, there has been a problem in that, when the electrode leader connecting each of the acoustic sensors and the signal processing circuit on the substrate becomes longer, a parasitic capacitance and parasitic resistance of the microphone become larger, to cause deterioration in characteristics such as the sensitivity.

Moreover, since the plurality of independent acoustic sensors are provided, disagreement of the acoustic characteristics other than the sensitivity tend to occur among each sensor. For example, since the frequency characteristics, phases and the like are influenced by a back chamber and a vent hole, each sensor tends to have different characteristics.

In the microphone of Patent Document 2, variations in sensitivity and other acoustic characteristics in each acoustic sensor tend to occur as thus described, and it has thus been difficult in practice to obtain the effect of improvement in S/N ratio.

Further, since the plurality of independent acoustic sensors need to be arranged in array on the substrate, there has been a problem of the microphone being not reducible in size.

PRIOR ART DOCUMENT

Patent Document

Patent Document 1: Japanese Unexamined Patent Publication No. 2008-5439

Patent Document 2: US Patent Publication No. 2007/0047746

DISCLOSURE OF THE INVENTION

Problems to be Solved by the Invention

The present invention was made in view of the technical problems as described above, and has an object to provide an acoustic sensor capable of improving an S/N ratio of a sensor without preventing reduction in size of the sensor, and a microphone using the acoustic sensor.

Means for Solving the Problem

An acoustic sensor of the present invention is an acoustic sensor including: a substrate, having a hollow section; a thin film-like diaphragm, arranged above the substrate so as to cover the hollow section; a movable electrode plate, formed on the diaphragm; a back plate, fixed to the top surface of the substrate so as to be opposed to the diaphragm; and a fixed electrode plate, provided on the back plate in a position opposed to the movable electrode plate, characterized in that the diaphragm and the movable electrode plate are substantially divided by a slit into a plurality of areas, and a plurality of parallelly connected capacitors are configured by the respective divided movable electrode plates and the fixed electrode plate. In addition, the movable electrode plate may be provided on the diaphragm, or the diaphragm itself may serve as a movable electrode plate.

In the acoustic sensor of the present invention, since the diaphragm is only substantially divided by a slit into the plurality of areas, the capacitance and the sensitivity with respect to the acoustic vibration remain substantially unchanged from those before division of the diaphragm. Meanwhile, since each divided area of the diaphragm can move almost independently, each area is displaced in an independent and discontinuous manner with respect to thermal noise, and when noise in each area is added up, the noise cancels one another, so as to be reduced. This results in improvement in S/N ratio of the acoustic sensor. Furthermore, the diaphragm is divided into the plurality of areas to perform acoustic detection in each area, thereby not preventing reduction in size of the acoustic sensor.

Further, when the opening in the diaphragm and the movable electrode plate becomes wider, air tends to leak through the diaphragm and the movable electrode plate, leading to deterioration in low-frequency characteristics of the acoustic sensor. However, in the acoustic sensor according to the present invention, with the diaphragm and the movable electrode plate divided by the slit, the opening for dividing the diaphragm and the movable electrode plate can be made narrow, so as to prevent deterioration in low-frequency characteristics of the acoustic sensor and prevent a decrease in sensitivity thereof.

AN embodiment of the acoustic sensor according to the present invention has a feature in that the slit is formed in a position passing through a maximal displacement place of the diaphragm. In such an embodiment, since the slit is provided so as to pass through the maximal displacement place of the diaphragm, it is possible to increase the S/N ratio improving effect of the acoustic sensor.

Another embodiment of the acoustic sensor according to the present invention has a feature in that the respective areas of the diaphragm divided by the slit respectively have the maximal displacement places with the slit provided therebetween. In such an embodiment, since the respective areas of the divided diaphragm respectively have the maximal displacement places with the slit provided therebetween, it is possible to increase the S/N ratio improving effect of the acoustic sensor.

Yet another embodiment of the acoustic sensor according to the present invention has a feature in that the slit is located on a line segment connecting any two supporting places out of supporting places of the diaphragm. In this embodiment, since the slit is formed on the line segment connecting the supporting places of the diaphragm, a displacement of the end of the slit can be made small so that a stress concentration at the end of the slit can be made small.

In yet another embodiment of the acoustic sensor according to the present invention, the slit may be partially interrupted, and the respective areas of the diaphragm, which are located on both sides of the slit with the slit provided therebetween, may be partially connected to each other through the interrupted portion of the slit.

Yet another embodiment of the acoustic sensor according to the present invention has a feature in that the width of the slit is not larger than 10 μm. In a MEMS acoustic sensor of a general size, when the width of the slit exceeds 10 μm, a roll-off frequency may become as high as 500 Hz to cause deterioration in low-frequency characteristics, and hence the width of the slit is desirably not larger than 10 μm as in this embodiment.

Yet another embodiment of the acoustic sensor according to the present invention has a feature in that a length of the slit is not smaller than a half of a distance across length of the diaphragm in an extending direction of the slit. When a length of the slit is shorter than a half of the width of the diaphragm, discontinuity of the displacement among each area of the diaphragm divided by the slit is impaired, and the effect of reducing noise as a whole deteriorates, whereby the length of the slit is desirably not smaller than a half of the distance across length of the diaphragm in the extending direction of the slit.

Although the shape of the diaphragm is not particularly restricted in the acoustic sensor according to the present invention, the diaphragm in circular form or rectangular form is desirably used in terms of the characteristics of the acoustic sensor.

Yet another embodiment of the acoustic sensor according to the present invention has a feature in that an edge of the diaphragm is supported by the substrate or the back plate at a plurality of supporting places, and a void is provided in at least one place between the adjacent supporting places out of the supporting places. When a whole perimeter of the diaphragm is fixed, the spring properties of the diaphragm tend to increase and the sensitivity of the acoustic sensor tend to decrease, but in the embodiment, the diaphragm is partially fixed, so that the spring properties of the diaphragm can be prevented from increasing and the sensitivity of the acoustic sensor can be prevented from decreasing. Further, a void between the supporting places can be used as a ventilation hole.

Yet another embodiment of the acoustic sensor according to the present invention has a feature in that an acoustic vibration reaches the diaphragm through the hollow section. According to such an embodiment, since the hollow section inside the substrate serves as a front chamber and a space outside the acoustic sensor serves as a back chamber, a volume of the back chamber can be made large, so as to improve the sensitivity of the acoustic sensor.

A microphone according to the present invention is a microphone provided with: the acoustic sensor according to the present invention; and a circuit for processing a signal outputted from the acoustic sensor. With the microphone of the present invention using the acoustic sensor of the present invention, it is possible to improve the S/N ratio of the microphone.

It is to be noted that the means for solving the above problems in the present invention has features in appropriate combination of the above described constitutional elements, and the present invention enables a large number of variations by combination of such constitutional elements.

BEST MODE FOR CARRYING OUT THE INVENTION

Hereinafter, preferred embodiments of the present invention will be described with reference to the accompanying drawings. However, the following embodiments of the present invention are not restrictive, and a variety of changes in design can be made within the range not deviating from the gist of the present invention.

(First Embodiment)

Figure 1:
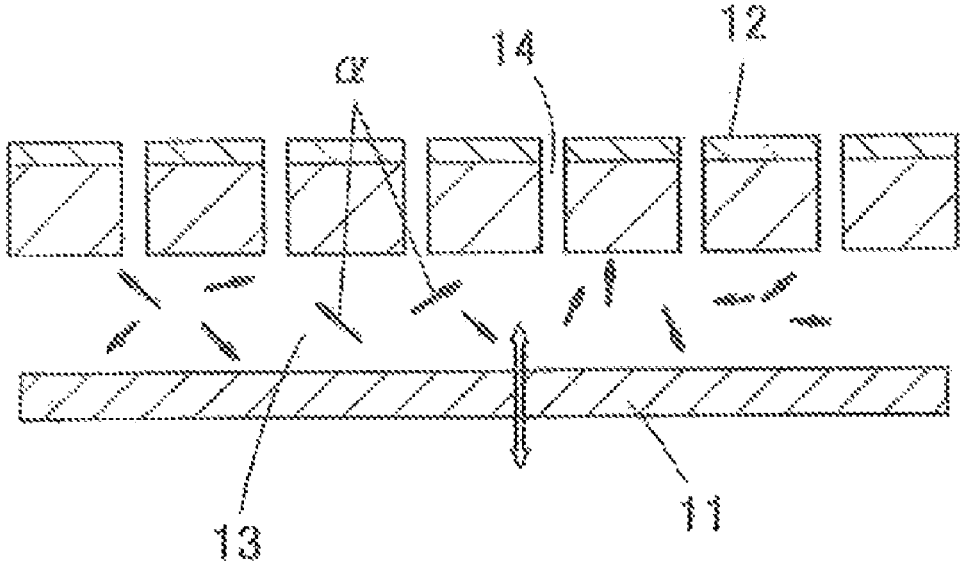
FIGS. 1(A) and 1(B) are schematic views for explaining thermal noise of an acoustic sensor.
Figure 1:
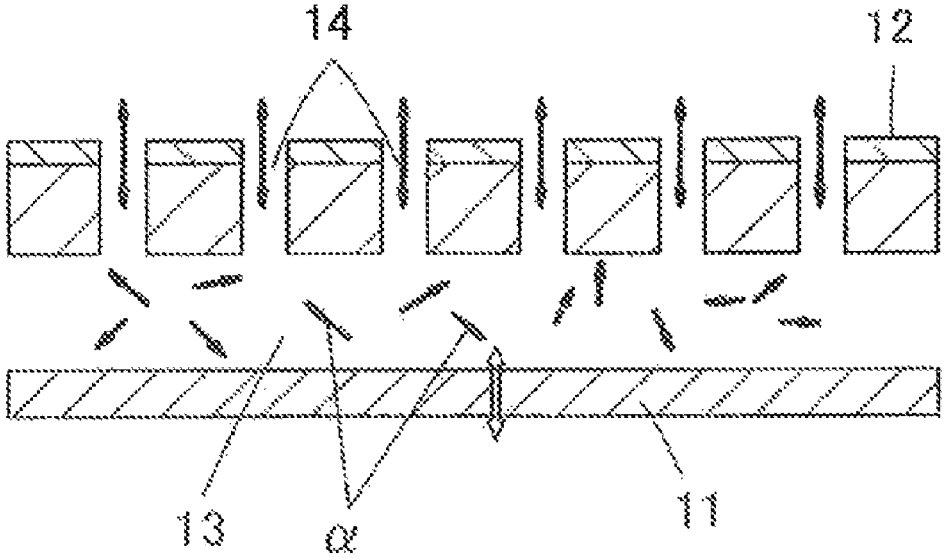
Figure 2:
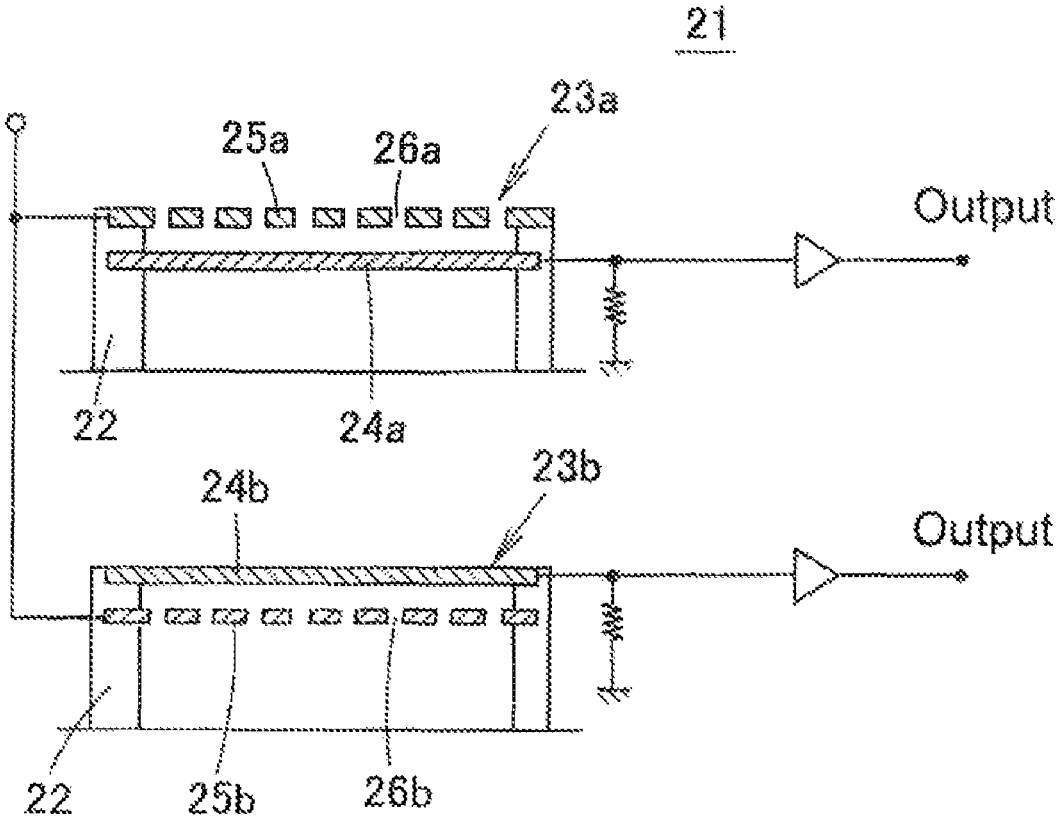
FIG. 2 is a schematic explanatory view of a microphone disclosed in Patent Document 1.
Figure 3:
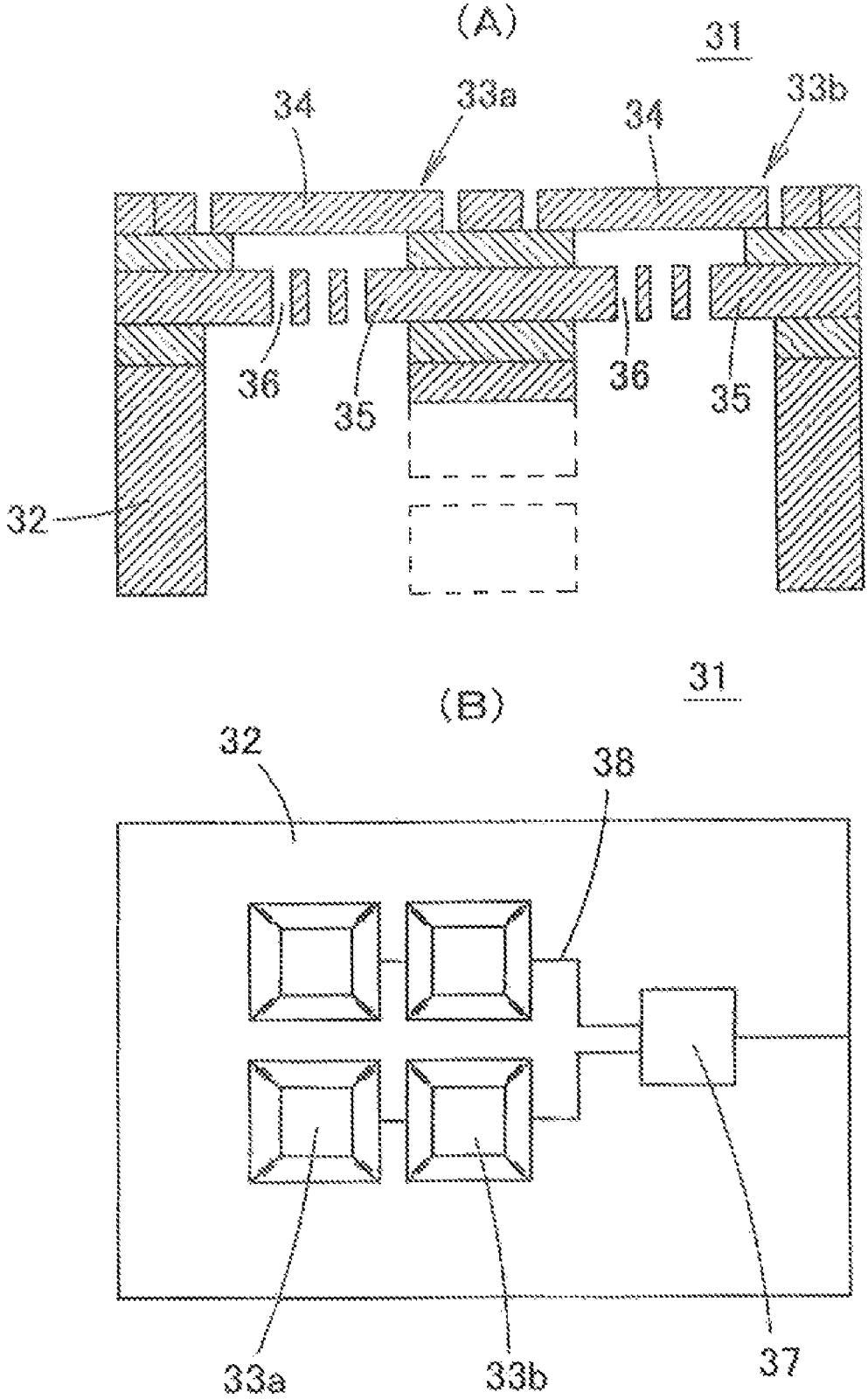
FIGS. 3(A) and (B) are a sectional view and a plan view of a microphone disclosed in Patent Document 2.
Figure 4:
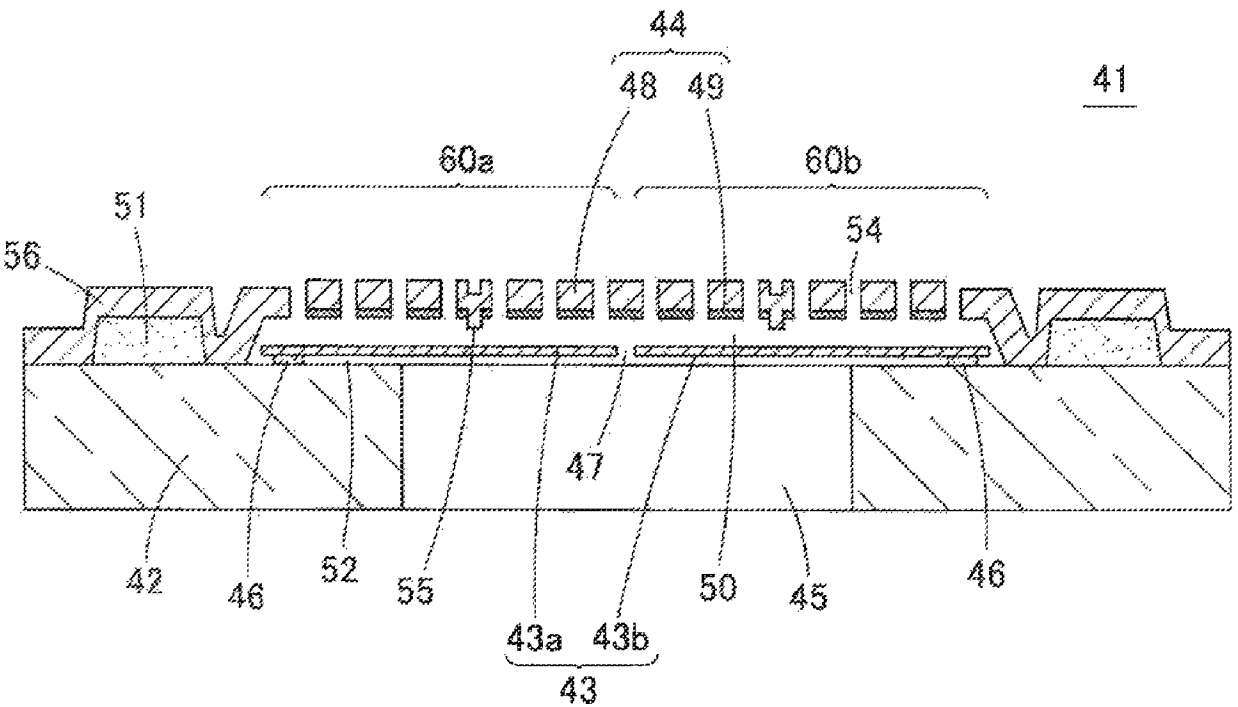
FIG. 4 is a sectional view of an acoustic sensor according to Embodiment 1 of the present invention.
Figure 5:
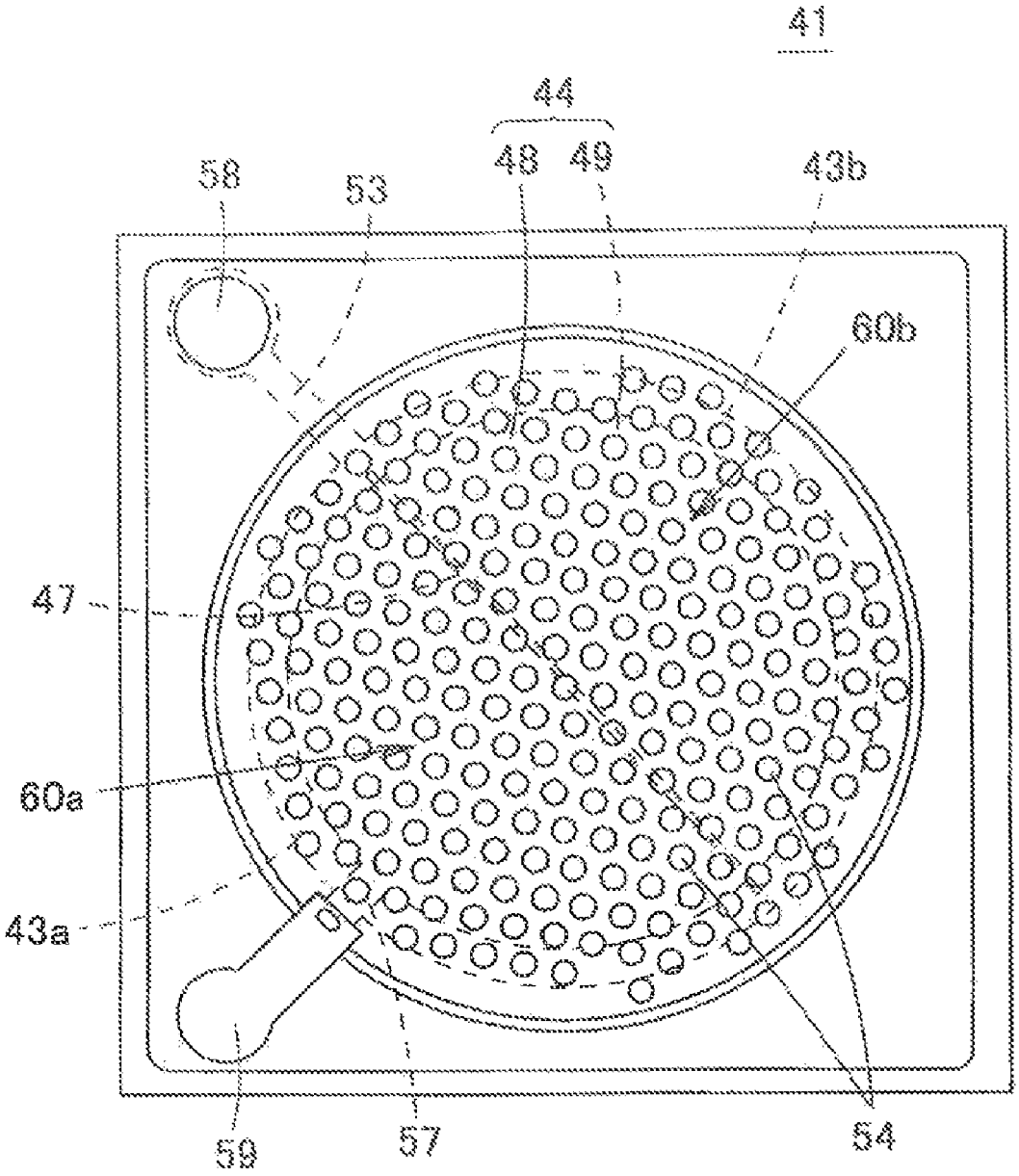
FIG. 5 is a plan view of the acoustic sensor of Embodiment 1.
Figure 6:
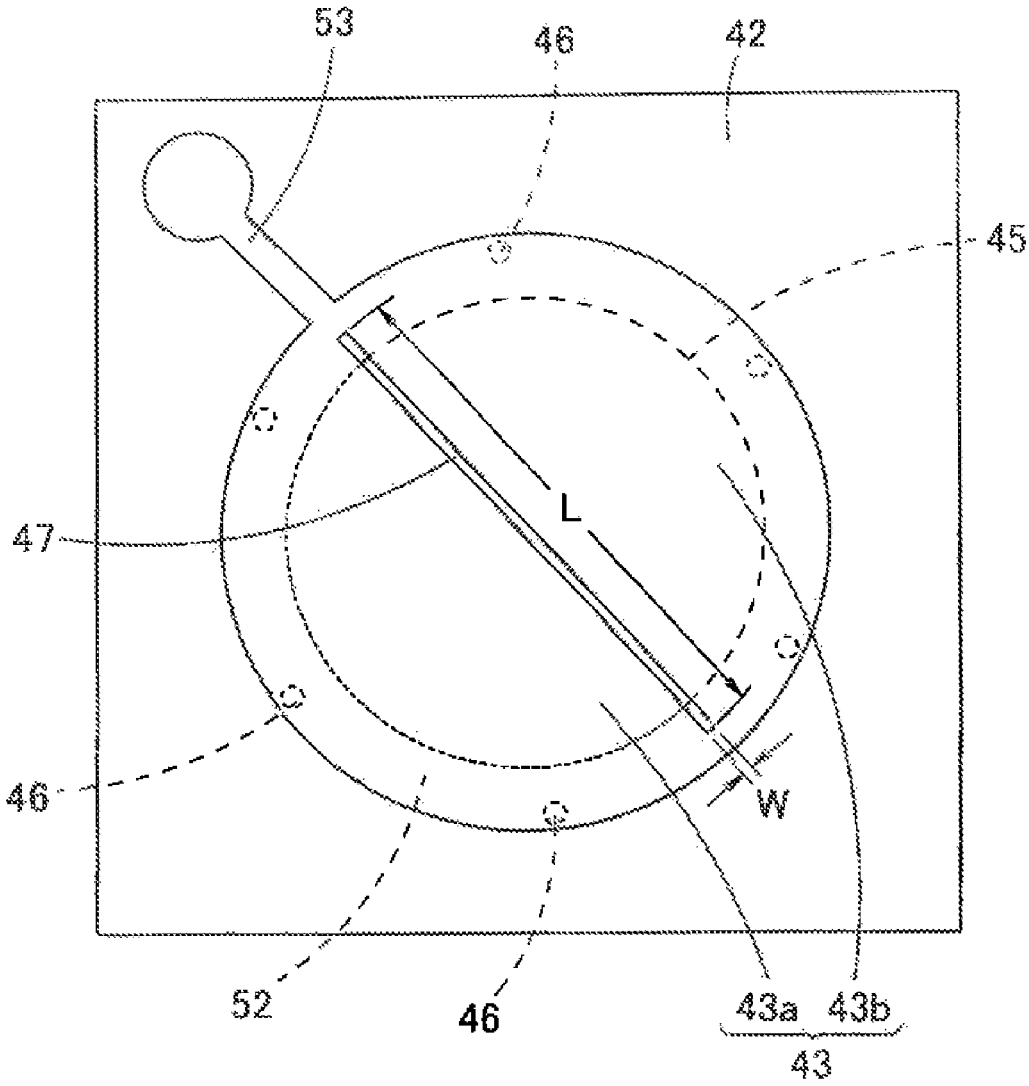
FIG. 6 is a plan view showing a shape of a diaphragm in the acoustic sensor of Embodiment 1.

A structure of an acoustic sensor according to Embodiment 1 of the present invention will be described with reference to FIGS. 4 to 6. FIG. 4 is a sectional view showing an acoustic sensor 41 of Embodiment 1. FIG. 5 is a plan view of the acoustic sensor 41. Further, FIG. 6 is a plan view showing a state where a canopy section 44 has been removed from the acoustic sensor 41.

This acoustic sensor 41 is a capacitance type element produced through use of the MEMS technique. As shown in FIG. 4, in the acoustic sensor 41, a diaphragm 43 (vibration electrode plate) is provided on the top surface of a silicon substrate 42 (semiconductor substrate) via an anchor 46, and to the top thereof, the canopy section 44 is fixed via a minute air gap 50 (void).

In the silicon substrate 42 made up of single-crystal silicon, a back chamber 45 (hollow section) penetrating from the front surface to the back surface is opened. The inner peripheral surface of the back chamber 45 may be a vertical surface or be inclined in taper form.

A plurality of anchors 46 for supporting the under surface of an outer edge of a diaphragm 43 are provided at almost regular intervals on the top surface of the silicon substrate 42. Further, on the top surface of the silicon substrate 42, a base section 51 is formed so as to surround the diaphragm 43. The anchor 46 and the base section 51 are formed of $SiO_2$.

As shown in FIG. 6, the diaphragm 43 is formed in substantially circular form. The diaphragm 43 is formed of a polysilicon thin film having conductivity, and the diaphragm 43 itself serves as a movable electrode plate. The diaphragm 43 is arranged on the silicon substrate 42 so as to cover a space above the back chamber 45, and supported by the anchors 46 at almost regular intervals on the silicon substrate 42. Therefore, the diaphragm 43 is supported in the air, and between the adjacent anchors 46, a narrow vent hole 52 for allowing passage of an acoustic vibration is formed between the lower surface of the outer periphery of the diaphragm 43 and the top surface of the silicon substrate 42. Further, a strip-like leading wire 53 is extended outward from the diaphragm 43.

In the case of fixing a whole perimeter of the diaphragm 43 to the silicon substrate 42, binding force of the diaphragm 43 becomes stronger, leading to an increase in spring properties of the diaphragm 43 and a decrease in sensitivity of the acoustic sensor 41. For this reason, the diaphragm 43 is supported by the anchors 46 at regular intervals, to form the vent hole 52 (void) between each of the anchors 46, as described above.

The diaphragm 43 is uniformly divided into two portions by a linear slit 47 with a small width positioned so as to pass through the center as the maximal displacement place of the diaphragm 43. However, this is not that the diaphragm 43 is completely divided into two portions by the slit 47, but those are mechanically and electrically connected in the vicinity of the end of the slit 47. Hereinafter, two areas that are in semicircular form of the diaphragm 43 divided by the slit 47 will be referred to as diaphragms 43*a*, 43*b*. Both diaphragms 43*a*, 43*b* are formed in an identical shape with an identical size.

The canopy section 44 is formed by providing a fixed electrode plate 49 made of polysilicon on the under surface of the back plate 48 (fixed film) made of SiN. The canopy section 44 is formed in dorm form, having a hollow portion therebelow and covering the diaphragm 43 with the hollow portion. The minute air gap 50 (void) is formed between the under surface of the canopy section 44 (i.e., the under surface of the fixed electrode plate 49) and the top surface of the diaphragm 43. The fixed electrode plate 49 and the diaphragm 43 are opposed to each other, to constitute a capacitor.

In almost the whole of the canopy section 44, a large number of acoustic holes 54 for allowing passage of an acoustic vibration are punched so as to penetrate from the top surface to the under surface. As shown in FIGS. 4 and 5, the acoustic holes 54 are regularly arrayed. In the illustrative example, the acoustic holes 54 are arrayed in triangular form along three directions forming angles of 120° with respect to one another, but the holes may be arranged in rectangular form, concentric form or some other form.

As shown in FIG. 4, a minute stopper 55 (protrusion) in columnar form protrudes from the under surface of the canopy section 44. The stopper 55 protrudes integrally from the under surface of the back plate 48, and penetrates the fixed electrode plate 49 to protrude from the under surface of the canopy section 44. The stopper 55 has insulating properties since being made of SiN as is the back plate 48. This stopper 55 is one to prevent the diaphragm 43 from adhering to the fixed electrode plate 49 and not being separated therefrom due to electrostatic force.

A protective film 56 is continuously extended from the whole of the outer edge of the canopy-like back plate 48. The protective film 56 covers the base section 51 and an area on the outside thereof.

The leading wire 53 is fixed to the base section 51, and a leading wire 57 extracted from the fixed electrode plate 49 is also fixed to the top surface of the base section 51. Meanwhile, the protective film 56 is formed with an opening, through which a movable-side electrode pad 58 is formed on the top surface of the leading wire 53, and the movable-side electrode pad 58 is conducted to the diaphragm 43 through the leading wire 53. Further, a fixed-side electrode pad 59 provided on the top surface of the back plate 48 is conducted to the leading wire 57 via a through hole or the like, and conducted further to the fixed electrode plate 49.

In this acoustic sensor 41, the diaphragm 43 is divided into two portions, the diaphragm 43*a* and the diaphragm 43*b*. Herewith, between the common canopy section 44 and back chamber 45, one acoustic sensing section 60*a* is configured by a capacitor made up of the diaphragm 43*a* and an area of the fixed electrode plate 49 which is opposed to the diaphragm 43*a*. Further, the other acoustic sensing section 60*b* is configured by a capacitor made up of the diaphragm 43*b* and an area of the fixed electrode plate 49 which is opposed to the diaphragm 43*b*. Furthermore, both sensing sections 60*a*, 60*b* are integrally formed in the same place inside the canopy section 44, and have the same configuration, the same shape and the same size, substantially having identical characteristics.

In this acoustic sensor 41, when an acoustic vibrations passes through the acoustic holes 54 and enters the air gap 50 inside the canopy section 44, the diaphragms 43*a*, 43*b* as the thin films vibrate with the same phase by the acoustic vibration. When the diaphragms 43*a*, 43*b* vibrate and a gap distance between each of the diaphragms 43*a*, 43*b* and the fixed electrode plate 49 changes, a capacitance of each of the sensing sections 60*a*, 60*b* changes.

This results in that in each of the sensing sections 60*a*, 60*b*, an acoustic vibration (change in sound pressure) being sensed by each of the diaphragms 43*a*, 43*b* becomes a change in capacitance between each of the diaphragms 43*a*, 43*b* and the fixed electrode plate 49, and is outputted as an electric signal. Further, since either the diaphragm 43*a* or 43*b* is connected to the movable-side electrode pad 58 and the fixed electrode plate 49 is common therebetween, the acoustic sensing section 60*a* (capacitor) and the acoustic sensing section 60*b* (capacitor) are electrically parallelly connected to each other.

In this acoustic sensor 41, the diaphragm 43*a* and the diaphragm 43*b* are electrically conducted to each other, and the fixed electrode plate 49 is common therebetween. Furthermore, the acoustic sensing sections 60*a*, 60*b* are provided in the same position on the substrate 42, and both sensing sections 60*a*, 60*b* sense an acoustic vibration with the same phase. For this reason, even with the diaphragms 43*a*, 43*b* separated from each other by the slit 47, the capacitance and the sensitivity of the acoustic sensor 41 with respect to an acoustic vibration remain substantially unchanged from those before formation of the slit 47.

As opposed to this, with the diaphragms 43*a*, 43*b* divided by the slit 47 and movable in an almost independent manner, the diaphragms 43*a*, 43*b* can be discontinuously displaced on both side of the slit 47. Hence thermal noise generated in the acoustic sensing section 60*a* and thermal noise generated in the acoustic sensing section 60*b* are sensed as signals with different phases. Therefore, when the noise of each of the sensing sections 60*a*, 60*b* is added up, the noise cancels one another, so as to be reduced. This results in improvement in S/N ratio of the acoustic sensor 41.

Figure 7:
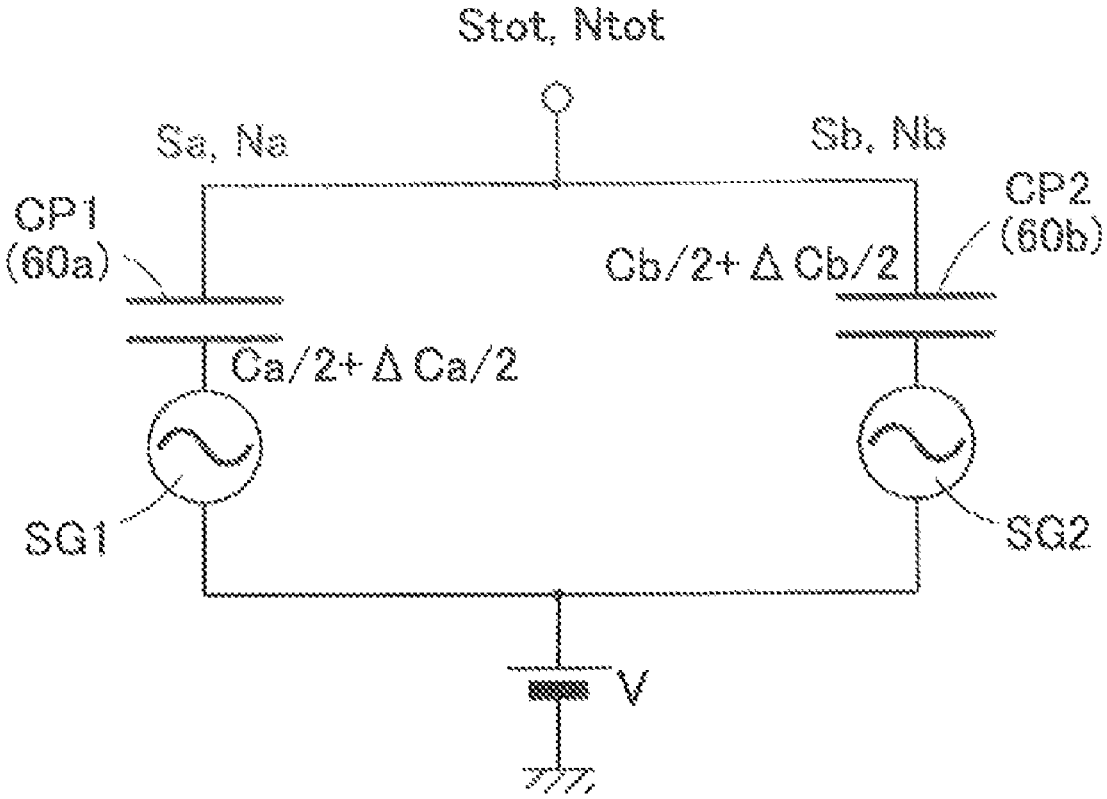
FIG. 7 is a diagram representing an equivalent circuit obtained by simplifying the acoustic sensor.

The reason for improvement in S/N ratio of the acoustic sensor 41 has been briefly described above, and it will further be described hereinafter, using an equivalent circuit. FIG. 7 represents an equivalent circuit obtained by simplifying the acoustic sensor 41. The two acoustic sensing sections 60*a*, 60*b* separated by the slit 47 is denoted by two parallelly connected variable capacitors CP1, CP2. Herein, the two variable capacitors CP1, CP2 have the same performance. Further, signal generating sources for an acoustic vibration, noise and the like are represented by alternators SG1, SG2 which are serially connected to the variable capacitors CP1, CP2, respectively. As a result, as shown in FIG. 7, the acoustic sensing section 60*a* is represented by a circuit serially connecting the variable capacitor CP1 and the alternator SG1, and the acoustic sensing section 60*b* is represented by a circuit serially connecting the variable capacitor CP2 and the alternator SG2. Further, the acoustic sensor 41 is represented by an equivalent circuit parallelly connecting both serial-connection circuits.

The characteristics or a circuit constant in the equivalent circuit of FIG. 7 are denoted by symbols as follows.

Ca/2[F]: capacitance of variable capacitor CP1

Cb/2[F]: capacitance of variable capacitor CP2

ΔCa/2[F]: change in capacitance of variable capacitor CP1 upon application of pressure ΔCb/2[F]: change in capacitance of variable capacitor CP2 upon application of pressure V[V]: voltage applied to acoustic sensor 41

Sa[V]: sensitivity output of acoustic sensing section 60*a*

Sb[V]: sensitivity output of acoustic sensing section 60*b*

Na[V]: noise output of acoustic sensing section 60*a*

Nb[V]: noise output of acoustic sensing section 60*b*

Sa/Na: S/N ratio of acoustic sensing section 60*a*

Sb/Nb: S/N ratio of acoustic sensing section 60*b*

Herein, the sensitivity output is a signal output coming from the acoustic sensing section (or variable capacitor) by an acoustic vibration generated in the alternator, and expressed by: (voltage)×(change in capacitance of fixed capacitor)/(capacitance of fixed capacitor). Therefore, the sensitivity output of the acoustic sensing section 60*a* is: Sa=V×(ΔCa/2)/(Ca/2)=V×ΔCa/Ca. Similarly, the sensitivity output of the acoustic sensing section 60*b* is: Sb=V×(ΔCb/2)/(Cb/2)=V×ΔCb/Cb.

Figure 8:
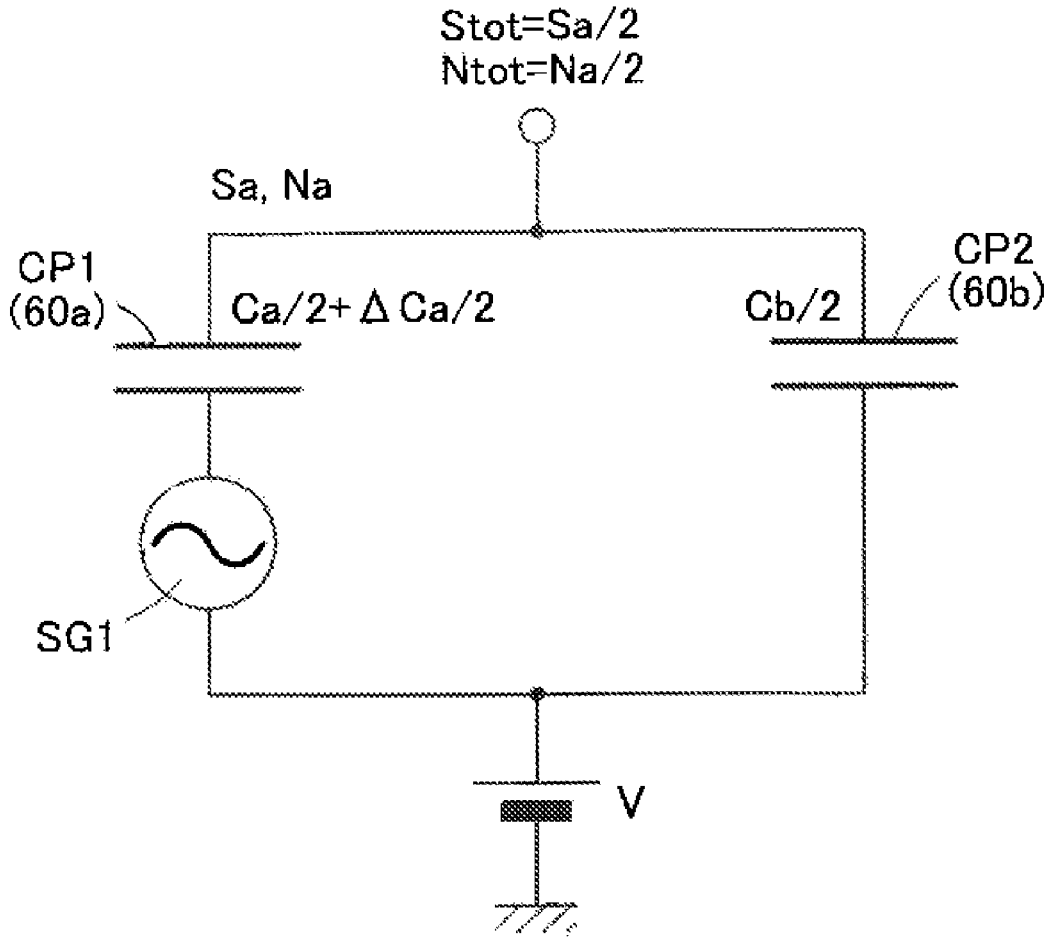
FIG. 8 is an equivalent-circuit diagram representing a state where only one acoustic sensing section is added with an acoustic vibration and noise.

Herein, a state where only the acoustic sensing section 60*a* is added with an acoustic vibration and noise, as shown in FIG. 8, is considered. In the acoustic sensing section 60*b*, since a signal due to an acoustic vibration or noise is not generated, the alternator SG2 of the acoustic sensing section 60*b* is omitted, and it is considered that the capacitance of the variable capacitor CP1 remains unchanged.

First, when only an acoustic vibration is outputted from the alternator SG1, a sensitivity output made from the acoustic sensing section 60*a* is: Sa=V×ΔCa/Ca, as described above. However, with the capacitor CP2 of the acoustic sensing section 60*b* parallelly connected to the acoustic sensing section 60*a*, the capacitor CP2 acts as a parasitic capacitance on the acoustic sensing section 60*a*, to alleviate the sensitivity of the acoustic sensing section 60*a*. With the capacitors CP1, CP2 having the same capacitance, a sensitivity output Stot made from the acoustic sensor 41 (i.e., a sensitivity output inputted into the signal processing circuit) is reduced into half as expressed in the following formula.

$$Stot=[(Ca/2)/\{(Ca/2)+(Cb/2)\}]\times Sa=Sa/2$$

Next, the case is considered where only noise is outputted from the power source SG1. Also in this case, when a noise output made from the acoustic sensing section 60*a* is denoted by Na, due to an influence of the capacitor CP2 parallelly connected to the acoustic sensing section 60*a*, a noise output Ntot made from the acoustic sensor 41 (i.e., a noise output inputted into the signal processing circuit) is reduced into half as expressed in the following formula.

$$Ntot=[(Ca/2)/\{(Ca/2)+(Cb/2)\}]\times Na=Na/2$$

In a state where only the acoustic sensing section 60*b* is added with an acoustic vibration as opposed to FIG. 8, considering this state similarly to the case of FIG. 8, the sensitivity output Stot made from the acoustic sensor 41 is expressed as in the following formula as a sensitivity output Sb of the acoustic sensing section 60*b* is reduced into half.

$$Stot=[(Cb/2)/\{(Cb/2)+(Ca/2)\}]\times Sb=Sb/2$$

Further, considering a state where noise is generated only in the acoustic sensing section 60*b*, due to an influence of the capacitor CP1 of the acoustic sensing section 60*a*, a noise output Ntot made from the acoustic sensor 41 is expressed by the following formula as a noise output Nb of the acoustic sensing section 60*b* is reduced into half.

$$Ntot=[((Cb/2)/\{(Cb/2)+(Ca/2)\}]\times Nb=Nb/2$$

Next, a case is considered where the sensitivity outputs Sa, Sb and the noise outputs Na, Nb are simultaneously generated in the acoustic sensing sections 60*a*, 60*b*, as shown in FIG. 7. The sensitivity output and the noise output are separately considered. As for the sensitivity output, with the respective diaphragms 43*a*, 43*b* sensing the acoustic vibration arranged in highly proximate positions inside the same canopy section 44, both diaphragms 43*a*, 43*b* are vibrating with the same phase and amplitude at the same time. Furthermore, the variable capacitor CP1 of the acoustic sensing section 60*a* and the variable capacitor CP2 of the acoustic sensing section 60*b* are parallelly connected to each other. As a result, the sensitivity output Stot of the acoustic sensor 41 is obtained as the sum of the sensitivity outputs Sa/2, Sb/2 of the respective acoustic sensing sections 60*a*, 60*b*, having been obtained above.

$$Stot=Sa/2+Sb/2$$

Figure 9:
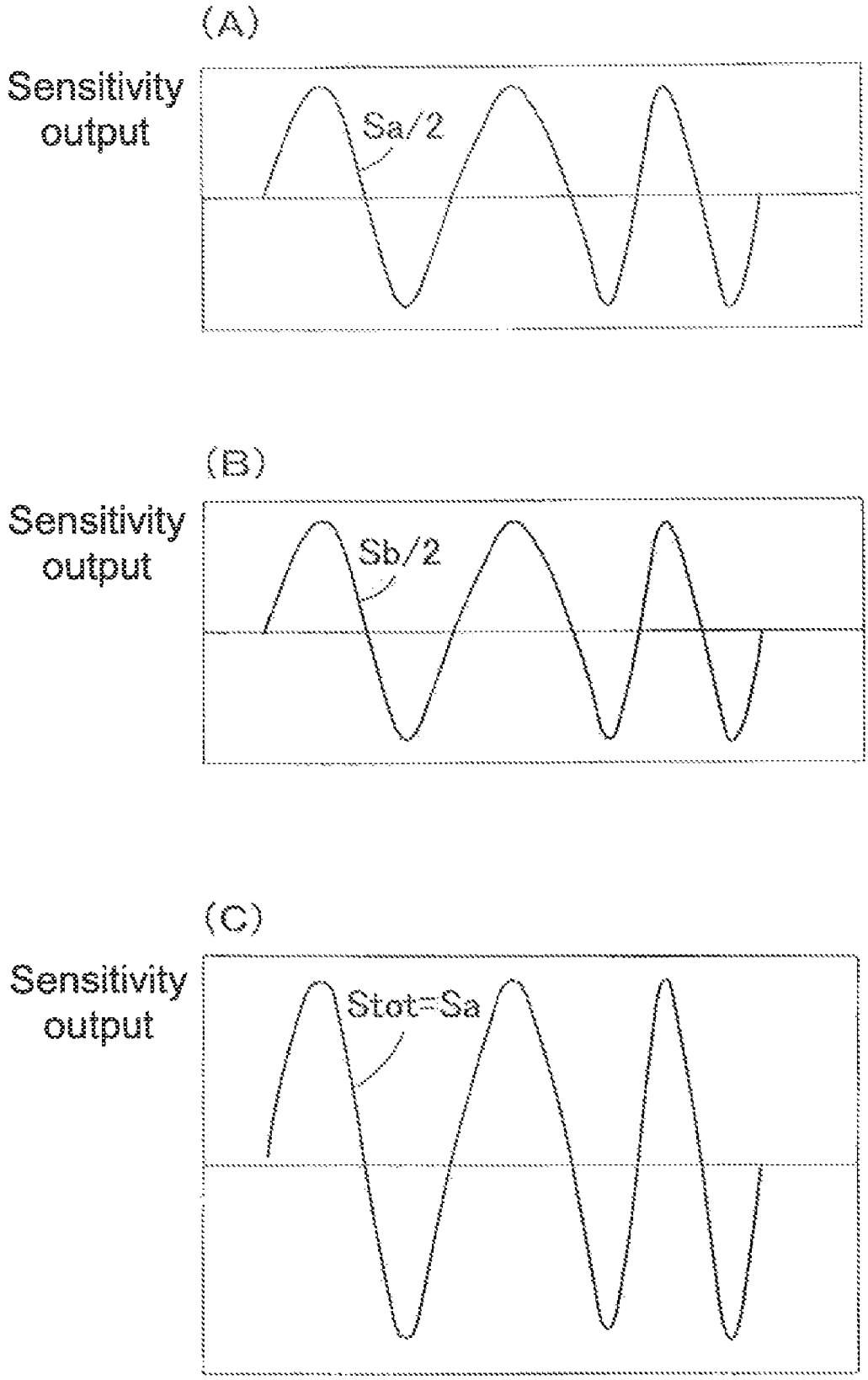
FIG. 9(A) is a waveform diagram showing a sensitivity signal outputted from the acoustic sensor when only the one acoustic sensing section is added with an acoustic vibration.
FIG. 9(B) is a waveform diagram showing a sensitivity signal outputted from the acoustic sensor when only the other acoustic sensing section is added with an acoustic vibration.
FIG. 9(C) is a waveform diagram showing a sensitivity signal outputted from the acoustic sensor when both acoustic sensing section are simultaneously added with an acoustic vibration.

Herein, with Sa=Sb, the above formula is expressed as: Stot=Sa. This represents that as shown in FIGS. 9(A) to 9(C), one obtained by superimposition of two signals (sensitivity outputs Sa/2, Sb/2 of FIGS. 9(A) and 9(B)) with the same phase and amplitude is outputted as the whole sensitivity output: Stot=Sa (FIG. 9(C)) in the acoustic sensor 41, and indicates that, even by provision of the slit 47, the sensitivity output Stot of the acoustic sensor 41 remains unchanged from that before provision of the slit 47.

Figure 10:
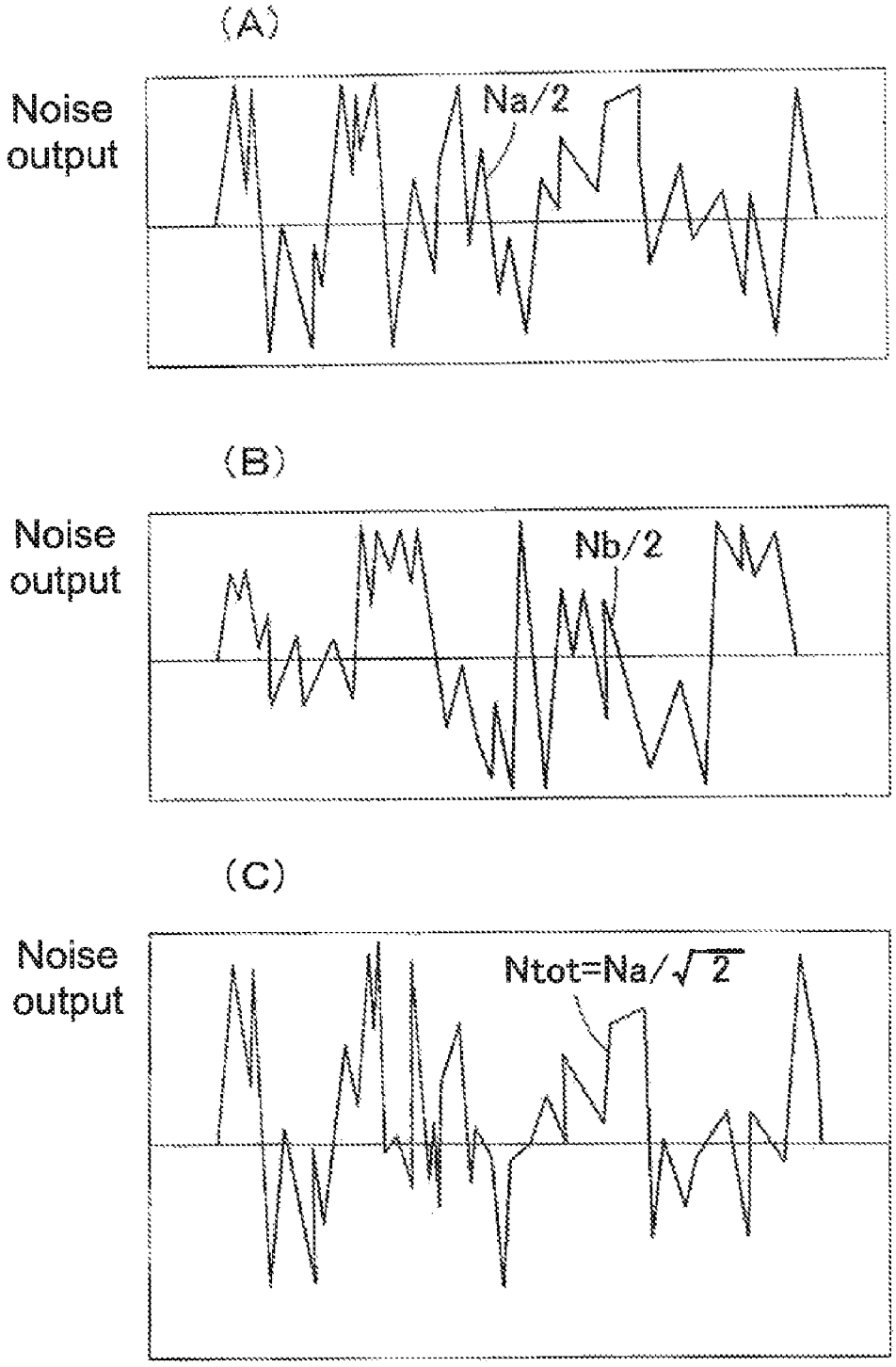
FIG. 10(A) is a waveform diagram showing a noise signal outputted from the acoustic sensor when noise is generated only in one acoustic sensing section.
FIG. 10(B) is a waveform diagram showing a noise signal outputted from the acoustic sensor when noise is generated only in the other acoustic sensing section.
FIG. 10(C) is a waveform diagram showing a noise signal outputted from the acoustic sensor when noise is generated simultaneously in both acoustic sensing sections.

On the other hand, since noise is derived from thermal noise, in the acoustic sensing sections 60*a*, 60*b* separated from each other by the slit 47, noise is independently generated at random. For this reason, noise of the acoustic sensing section 60*a* and noise of the acoustic sensing section 60*b* serve as independent signals with nonuniform phases and amplitudes, as shown in FIGS. 10(A) and 10(B). Hence, as shown in FIG. 10(C), the noise output Ntot made from the acoustic sensor 41 is obtained by calculation at the time of performing addition of dispersions of the noise output Na/2 made from the acoustic sensing section 60*a* and the noise output Nb/2 made from the acoustic sensing section 60*b*. That is, it is obtained as in the following formula.

$$Ntot=\sqrt{\{(Na/2)^2+(Nb/2)^2\}}$$

Herein, with Na=Nb, the above formula is expressed as: Ntot=Na/√(2).

As described above, the sensitivity output Stot of the acoustic sensor 41 is obtained by addition and the noise output Ntot thereof is obtained by calculation at the time of performing an addition of dispersions. As a result, the S/N ratio of the acoustic sensor 41 is √(2)Sa/Na, and as compared with the case of the slit 47 being not provided, the S/N ratio becomes √(2) times as large (or improves by 3 dB). According to a prototype, although no change is seen in sensitivity output before and after formation of the slit 47, the noise output decreased by 3 dB due to provision of the slit 47. Therefore, the S/N ratio increased by +3 dB by provision of the slit 47.

Accordingly, it is quantitatively shown that the S/N ratio of the acoustic sensor 41 can be improved by provision of the slit 47 in the diaphragm 43.

Next, the length and the width of the slit 47 provided in the diaphragm 43 are considered. A length L (see FIG. 6) of the slit 47 desirably crosses not less than 50% of the width of the diaphragm 43. That is, the length L of the slit 47 is desirably a length not smaller than a half of the width of the diaphragm 43 on a line as extension of the slit 47. This is because, the slit 47 is provided for the purpose of isolating a displacement on the diaphragm 43*a* side and a displacement on the diaphragm 43*b* side from each other so as to make them discontinuous, and if the length L of the slit 47 is smaller than a half of the width of the diaphragm 43, the discontinuity of the displacements on the diaphragm 43*a* side and the diaphragm 43*b* side is impaired.

Figure 11:
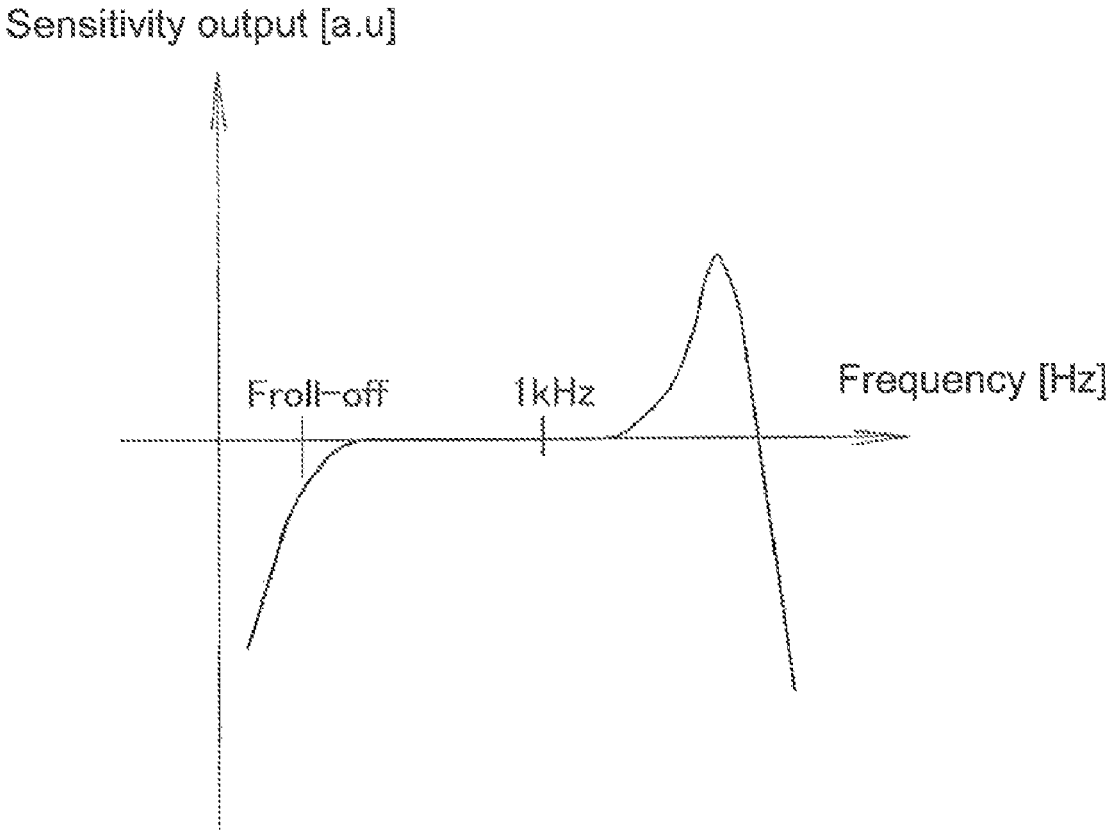
FIG. 11 is a view explaining a roil-off frequency.

Further, a width W (see FIG. 6) of the slit 47 is desirably not larger than 10 μm. This is because, if the width W of the slit 47 is excessively large, an amount of air, which passes through the slit 47 and leaks to the back chamber 45 through the air gap 50, increases and the roll-off frequency increases, leading to deterioration in low-frequency characteristics of the acoustic sensor 41. The roll-off frequency Froll-off is a frequency at the moment of decrease in sensitivity output by given dB on the low frequency side as shown in FIG. 11. Generally, the roll-off frequency Froll-off is inversely proportional to an acoustic resistance Rventhole of the vent hole 52 and a compliance Cbackchamber (=air spring constant) of air inside the back chamber 45, and expressed by the following formula.

$$\text{Froll-off} \propto 1/(\text{Rventholl} \cdot \text{Cbackchamber})$$

Therefore, when the width W of the slit 47 increases, the acoustic resistance Rventhole decreases and the roll-off frequency Froll-off increases, leading to deterioration in low-frequency characteristics of the acoustic sensor 41. While the acoustic resistance Rventhole is also influenced by the length L of the slit 47, for example, the roll-off frequency Froll-off is not larger than 50 Hz when the width W of the slit 47 is 1 μm, and the roll-off frequency Froll-off is 500 Hz when the width of the slit 47 is 10 μm. As thus described, when the width of the slit 47 exceeds 10 μm, the roll-off frequency becomes significantly high and the low-frequency characteristics deteriorate, to cause greatly impaired sensitivity of the acoustic sensor 41, whereby the width W of the slit 47 is desirably not larger than 10 μm.

Further, total force of pressure applied to each portion of the diaphragm due to thermal noise acts on the maximal displacement place of the diaphragm when the diaphragm has rigidity. Since the maximal displacement place of the diaphragm 43 before formation of the slit 47 is located at the center thereof, it is desirable that the slit 47 be formed so as to pass through the center of the diaphragm 43 and the respective divided diaphragms 43*a*, 43*b* have the maximal displacement places on both sides of the slit 47 with the slit provided therebetween.

In addition, in Embodiment 1 above as the most preferable embodiment, it has been configured such that the diaphragms 43*a*, 43*b* have the same shape and size, and the acoustic sensing sections 60*a*, 60*b* substantially have the same characteristics. However, the present invention is not necessarily restricted to such an embodiment, but the diaphragms 43*a*, 43*b* may have different shapes or different sizes and the acoustic sensing sections 60*a*, 60*b* may have different characteristics.

(Second Embodiment)

Figure 12:
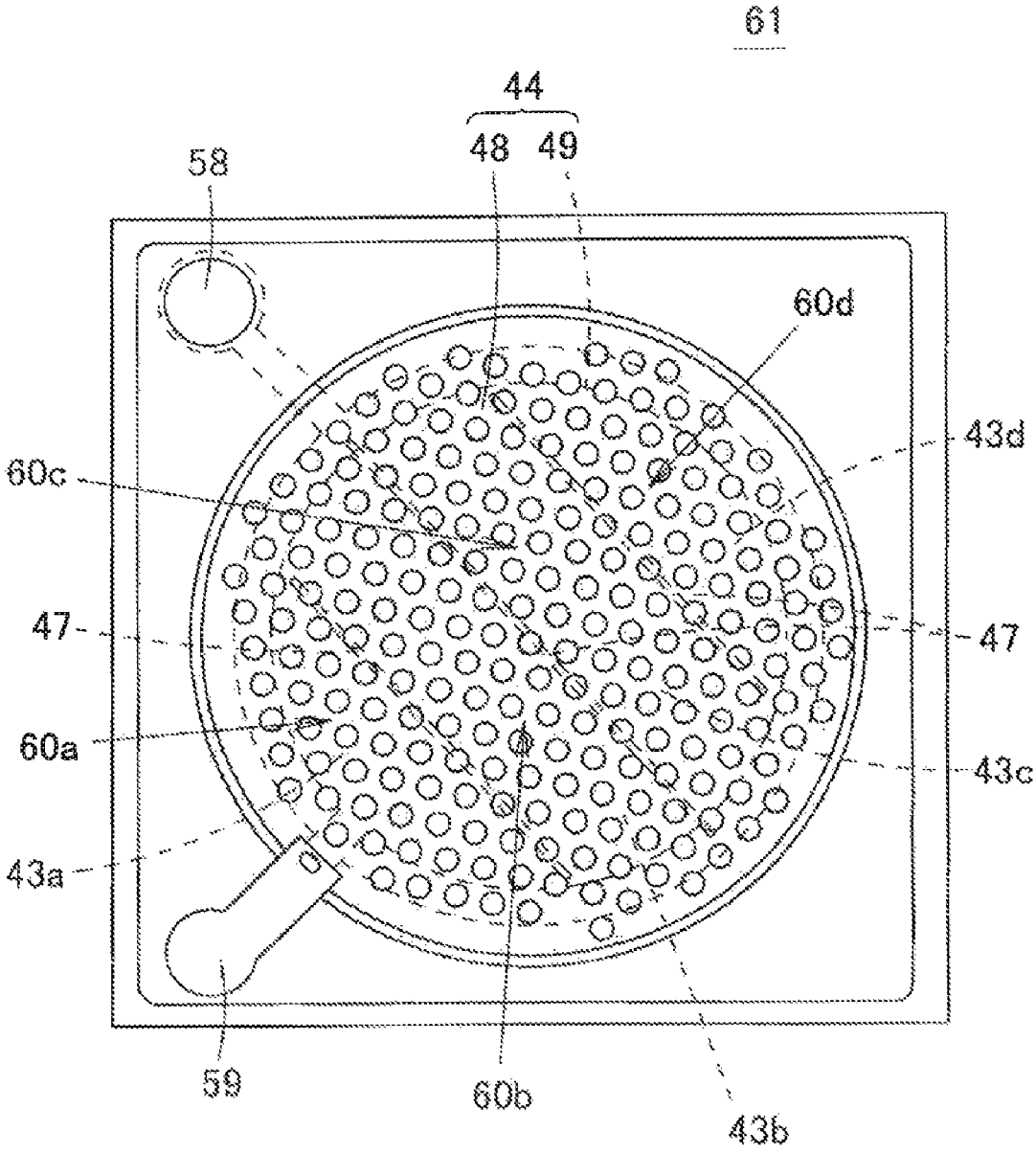
FIG. 12 is a plan view of an acoustic sensor according to Embodiment 2 of the present invention.
Figure 13:
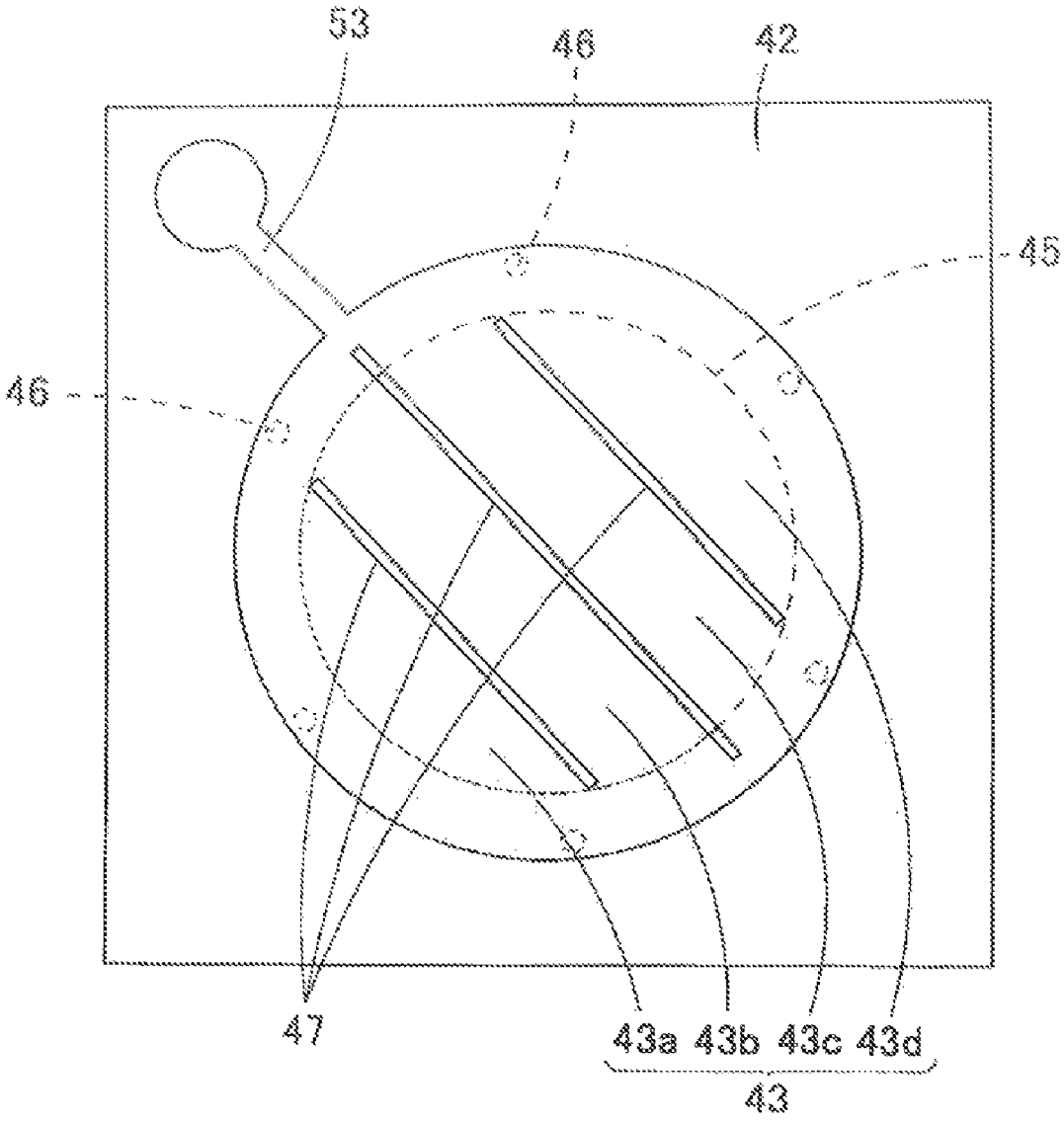
FIG. 13 is a plan view showing a shape of a diaphragm in the acoustic sensor of Embodiment 2.

FIG. 12 is a plan view of an acoustic sensor 61 according to Embodiment 2 of the present invention. FIG. 13 is a plan view of the acoustic sensor 61 in a state where the canopy section 44 has been removed.

In the acoustic sensor 61 of Embodiment 2, a plurality of (three in the illustrative example) slits 47 are provided in the diaphragm 43, to divide the diaphragm 43 into not less than three areas (four areas in the illustrative example) so as to provide a plurality of substantially independent diaphragms 43*a*, 43*b*, . . . . Then, each of the diaphragms 43*a*, 43*b*, . . . and the common fixed electrode plate 49 constitute a plurality of acoustic sensing sections 60*a*, 60*b*, . . . (capacitors).

The acoustic sensor 61 of Embodiment 2 is one where the number of division of the diaphragm 43 is larger than that in the acoustic sensor 41 of Embodiment 1. Even when the number of slits 47 increases to increase the number of division of diaphragm 43 in such a manner (the shape and area of each of the diaphragms 43*a*, 43*b*, . . . may differ), it is possible to increase the S/N ratio of the acoustic sensor 61 in a similar reason to in Embodiment 1. Further, when the number of division of the diaphragm 43 increases, the effect of reducing noise of the acoustic sensor 61 to increase the S/N ratio is enhanced in accordance with the increase.

(Third Embodiment)

Figure 14:
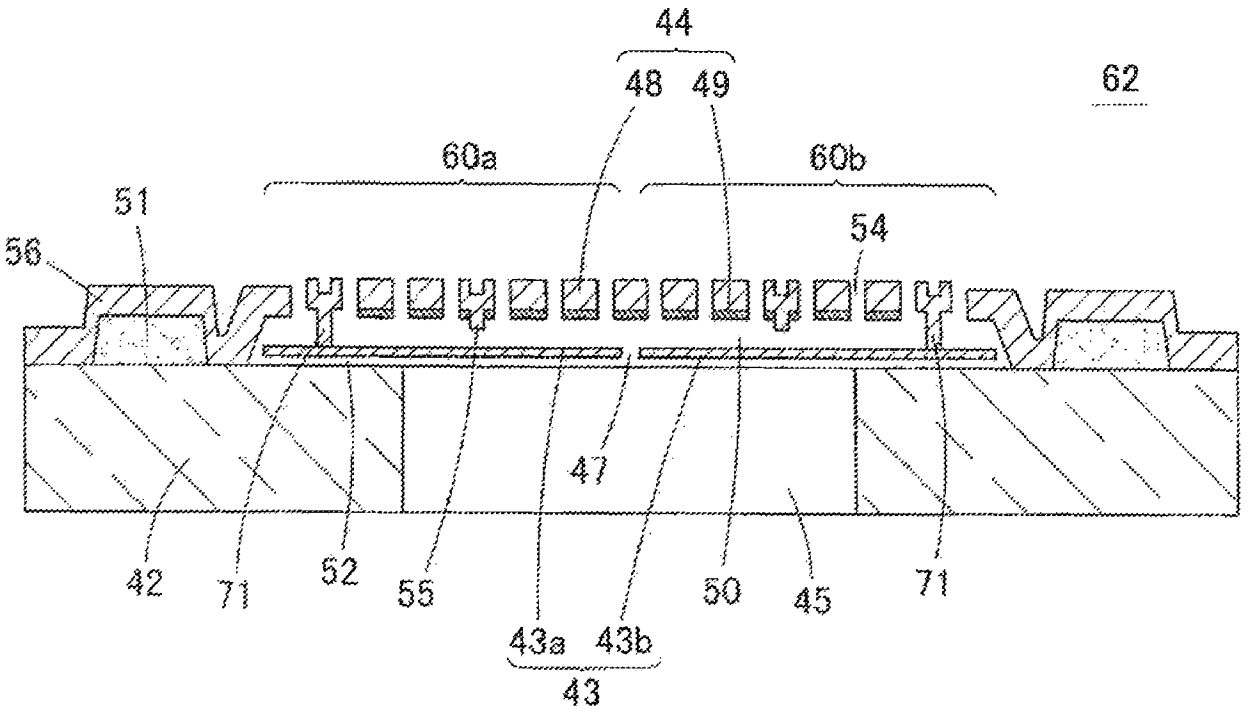
FIG. 14 is a sectional view showing an acoustic sensor according to Embodiment 3 of the present invention.
Figure 15:
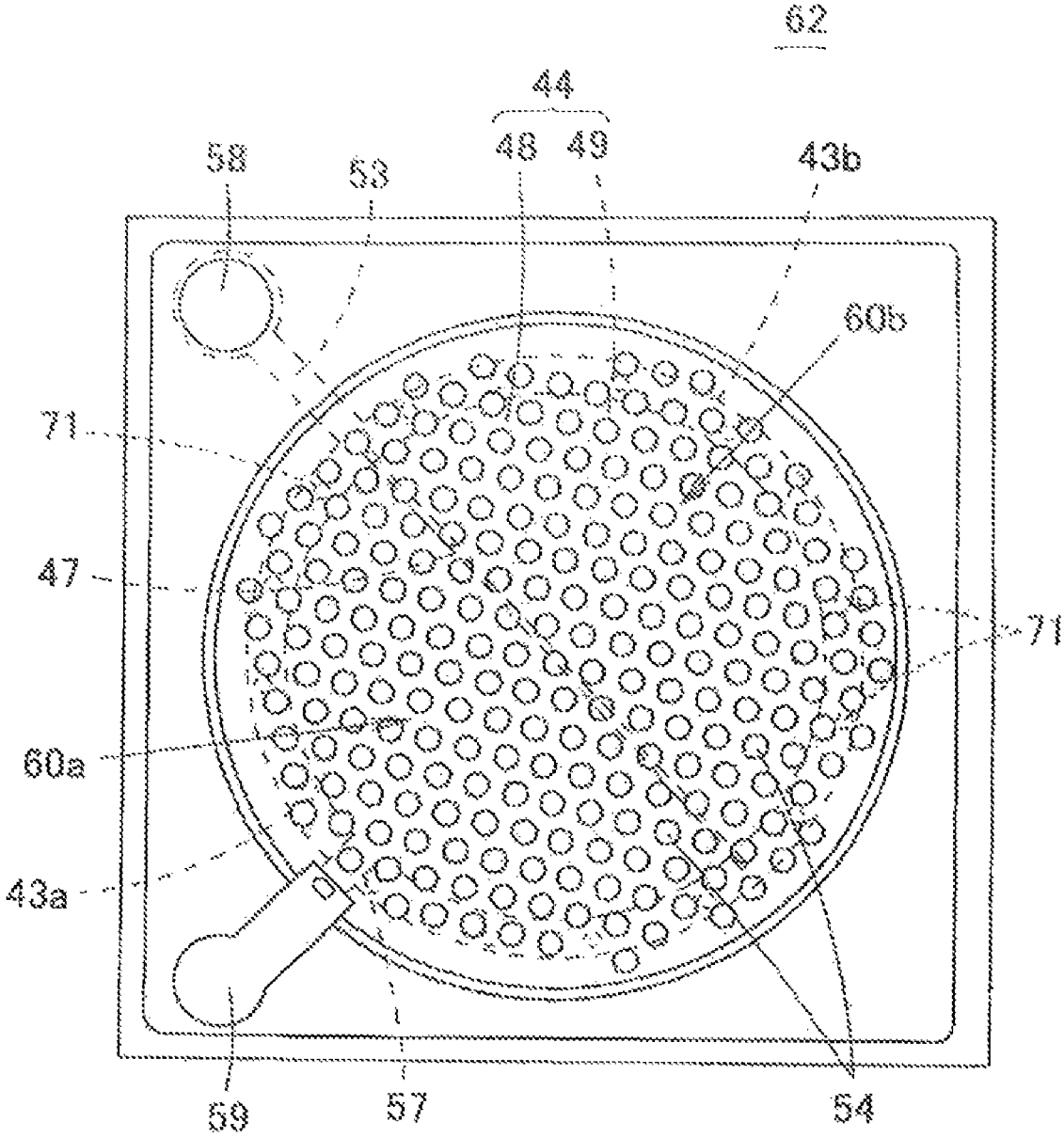
FIG. 15 is a plan view of the acoustic sensor of Embodiment 3.

FIG. 14 is a sectional view of an acoustic sensor 62 according to Embodiment 3 of the present invention. FIG. 15 is a plan view of the acoustic sensor 62 of Embodiment 3.

In the acoustic sensor 62 of Embodiment 3, the diaphragm 43 is not supported by the anchors 46 as in Embodiment 1, but is simply placed on the top surface of the silicon substrate 42. On the other hand, from a position opposed to the outer periphery of the diaphragm 43 out of the under surface of the back plate 48, a protrusion 71 to be brought into contact with the top surface of the diaphragm 43 is protruded downward. Therefore, when a voltage is applied between the diaphragm 43 and the fixed electrode plate 49, the diaphragm 43 is pulled up by electrostatic attractive force toward the fixed electrode plate 49. The diaphragm 43 pulled up upward comes into contact with the lower end surface of the protrusion 71 and is fixed thereto, and the fixed air gap 50 is formed between the diaphragm 43 and the fixed electrode plate 49. Upon application of an acoustic vibration to this diaphragm 43, a capacitance of a capacitor configured by the diaphragm 43 and the fixed electrode plate 49 changes, and the acoustic vibration is thus detected.

Further, the diaphragm 43 is provided with one slit (or may be a plurality of slits) 47 and the divided diaphragms 43*a*, 43*b* and the fixed electrode plate 49 constitute the two acoustic sensing sections 60*a*, 60*b*. Accordingly, also in this acoustic sensor 62, it is possible to improve the S/N ratio of the acoustic sensor 62 as in the case of Embodiment 1.

(Fourth Embodiment)

Figure 16:
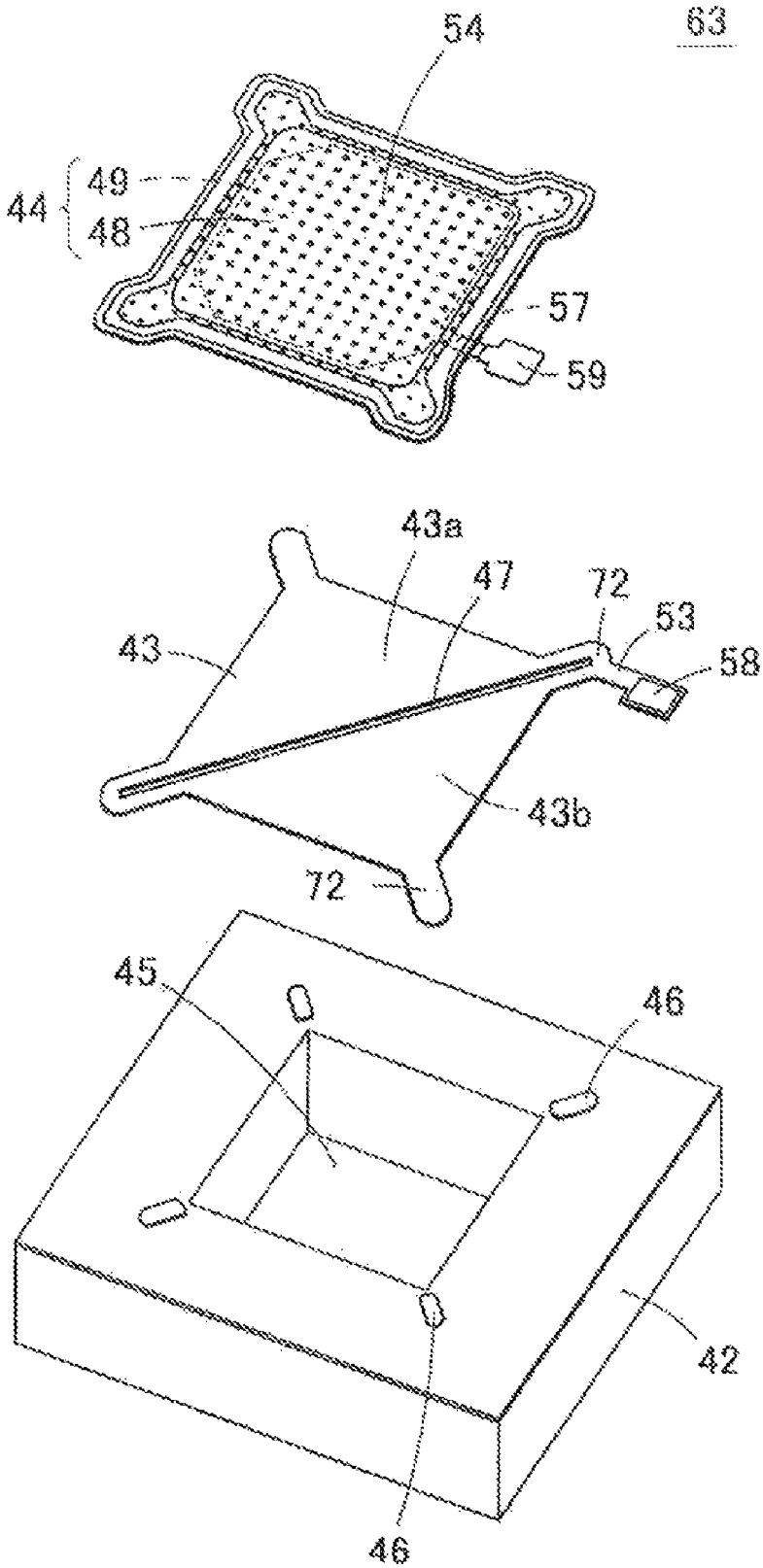
FIG. 16 is an exploded perspective view of an acoustic sensor according to Embodiment 4 of the present invention.
Figure 17:
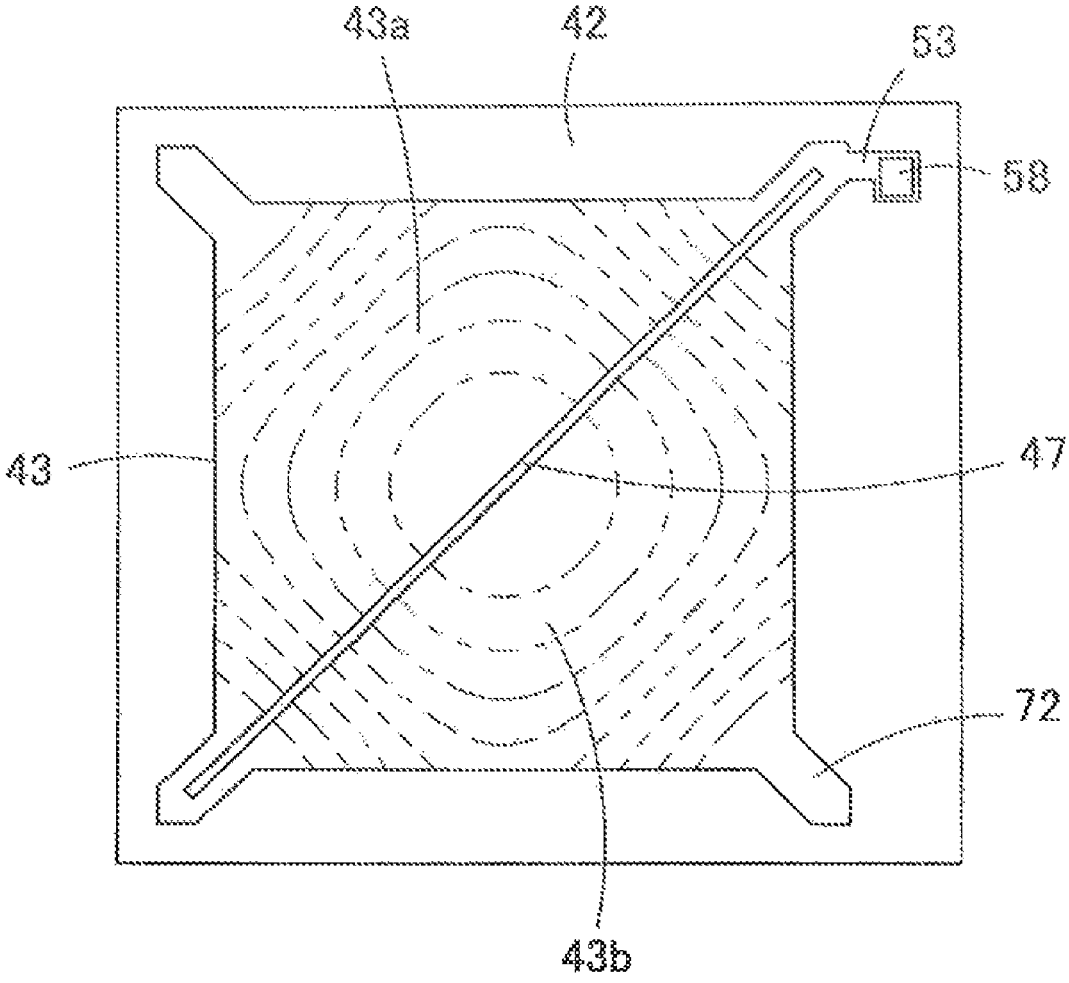
FIG. 17 is a plan view showing a shape of a diaphragm in the acoustic sensor of Embodiment 4.

FIG. 16 is an exploded perspective view of an acoustic sensor 63 according to Embodiment 4 of the present invention. FIG. 17 is a plan view showing a state where the canopy section 44 has been removed from the acoustic sensor 63.

This acoustic sensor 63 is one using a rectangular diaphragm 34. The back chamber 45 in columnar form is opened in the silicon substrate 42, and the diaphragm 43 is arranged on the top surface of the silicon substrate 42 so as to cover the upper-surface opening of the back chamber 45. Leg sections 72 are provided at four corners of the diaphragm 43, and each of the legs 72 is fixed to the diaphragm 43 by the anchor 46 provided on the top surface of the silicon substrate 42. The diaphragm 43 is divided into the diaphragms 43*a* and 43*b* by the slit 47 in a diagonal direction. The canopy section 44 is also formed in substantially rectangular form so as to cover the rectangular diaphragm 43.

Broken lines in FIG. 17 represent a displacement amount of the diaphragm 43 during displacement thereof due to acoustic vibrations by means of contours, and the displacement amount is larger at a position closer to the center. As thus described, in the diaphragm 43 with the four corners thereof fixed, the center is the maximal displacement place, and forming the slit 47 so as to pass through the maximal displacement place of the diaphragm 43 can increase the S/N ratio improving effect of the acoustic sensor 63.

(Fifth Embodiment)

Figure 18:
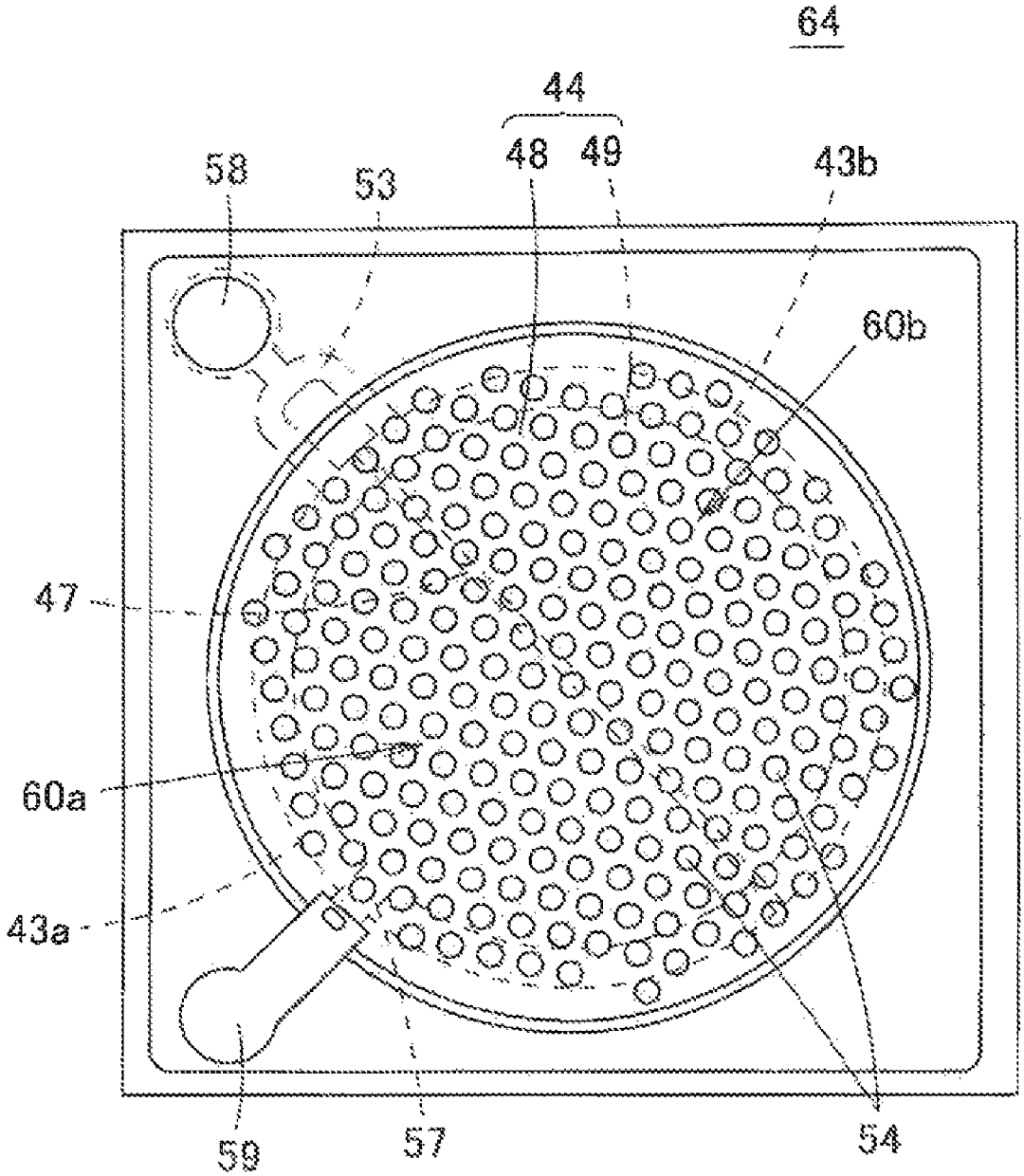
FIG. 18 is a plan view of an acoustic sensor according to Embodiment 5 of the present invention.
Figure 19:
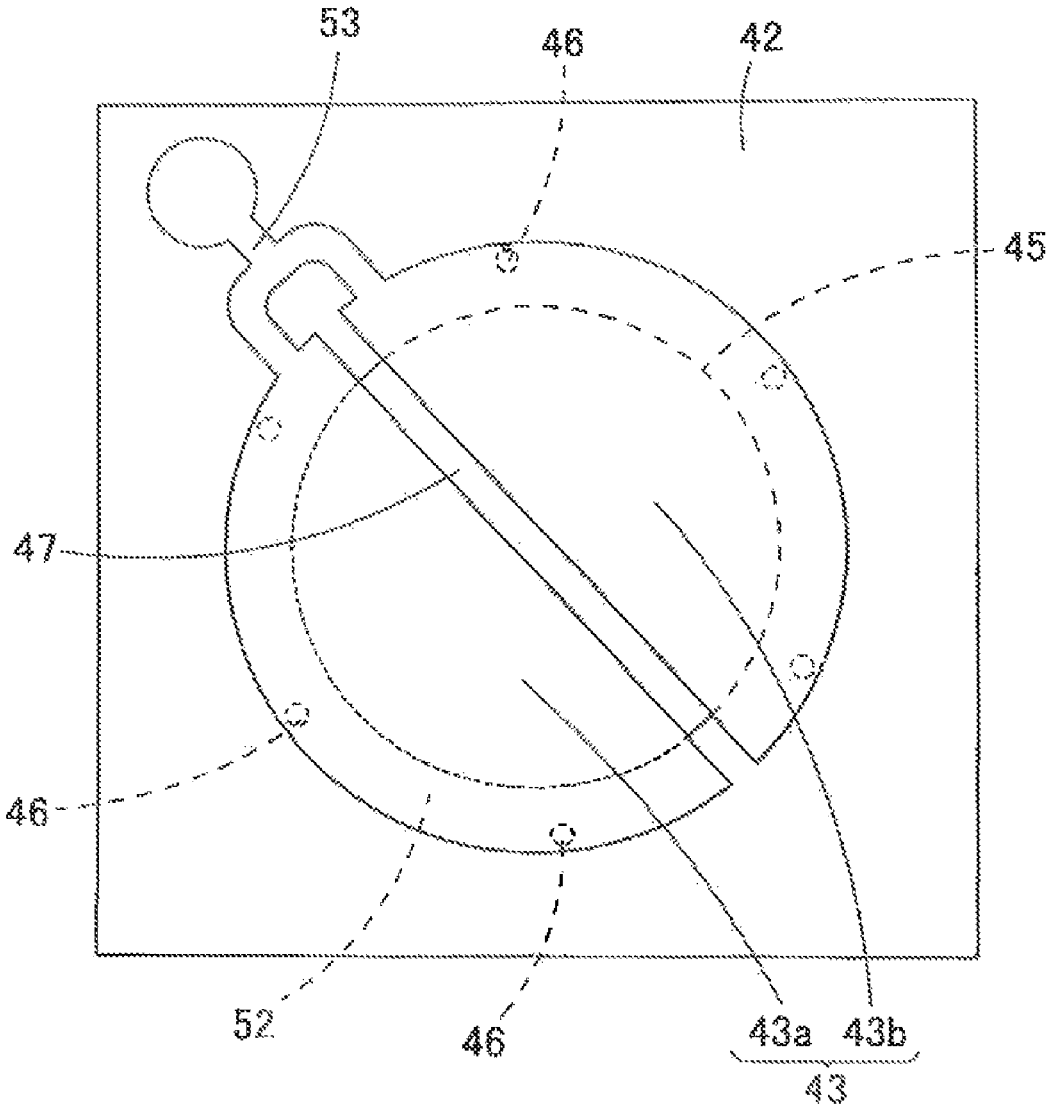
FIG. 19 is a plan view showing a shape of a diaphragm in the acoustic sensor of Embodiment 5.

FIG. 18 is a plan view of an acoustic sensor 64 according to Embodiment 5 of the present invention. FIG. 19 is a plan view showing a state where the canopy section 44 has been removed from the acoustic sensor 64.

In this acoustic sensor 64, the slit 47 is formed from the end to the end of the diaphragm 43 so as to pass through the center of the diaphragm 43. Therefore, in the diaphragm 43, the two diaphragm 43*a*, 43*b* are completely separated by the slit 47. Both diaphragms 43*a*, 43*b* as thus separated are connected by the leading wire 53 in bifurcated form formed on the top surface of the silicon substrate 42.

Completely separating the diaphragms 43*a*, 43*b* as thus described enhances the independency of the acoustic sensing sections 60*a*, 60*b* from each other.

Figure 20:
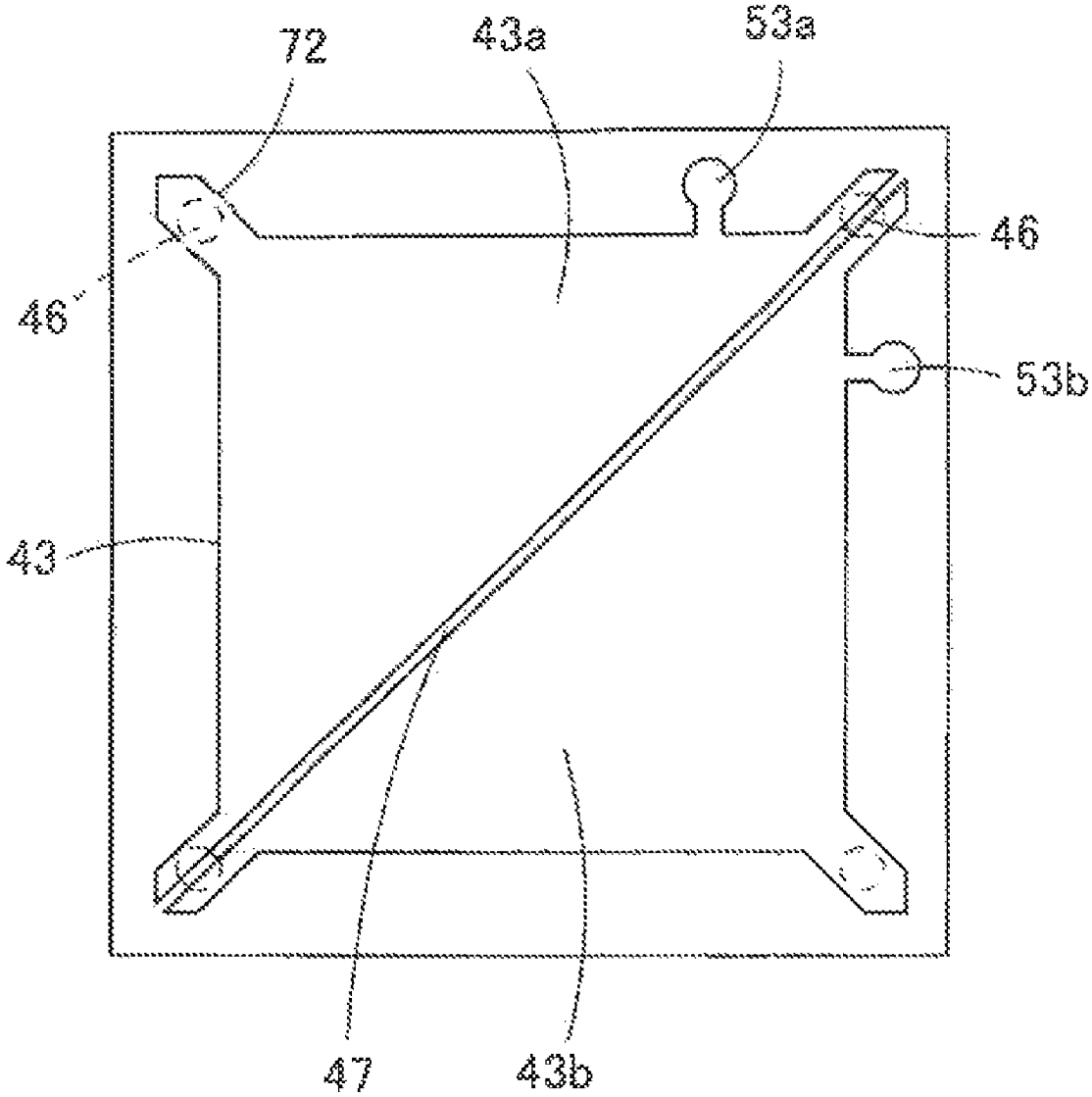
FIG. 20 is a plan view showing a shape of a diaphragm in a modified example of Embodiment 5.

In addition, in the case of the diaphragm 43 being completely divided by the slit 47, as shown in FIG. 20, leading wires 53*a*, 53*b* may be separately provided in the respective diaphragms 43*a*, 43*b*. These leading wires 53*a*, 53*b* may be connected to each other outside the acoustic sensor, or connected inside the signal processing circuit (ASIC).

(Sixth Embodiment)

Figure 21:
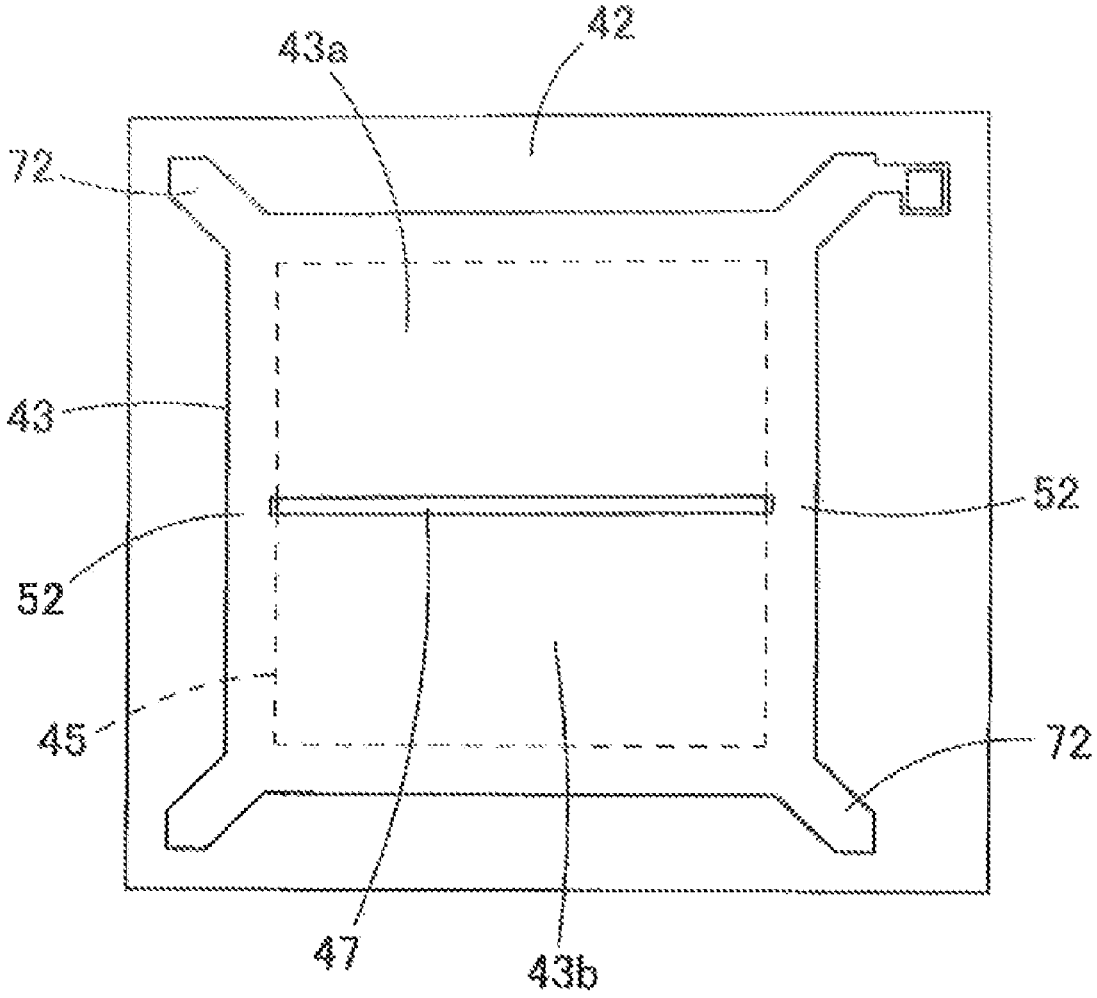
FIG. 21 is a plan view showing a shape of a diaphragm in the acoustic sensor according to Embodiment 6 of the present invention.

In the case of providing the slit 47 in the diaphragm 43, it is preferably provided so as to pass through the maximal displacement place of the diaphragm 43, but the direction of the slit 47 is not particularly restricted. For example, in the acoustic sensor 63 of Embodiment 4, the slit 47 has been provided in a direction in which the fixed places of the rectangular diaphragm 43 are connected, namely the diagonal direction of the diaphragm 43, but this is not necessarily restrictive. As shown in FIG. 21, the slit 47 may be formed in a parallel direction to the sides of the rectangular diaphragm 43. In this case, since it is a direction in which the centers of the right and left vent holes 52 are connected to each other, either the divided diaphragm 43*a* or 43*b* is supported in cantilever form.

Figure 22:
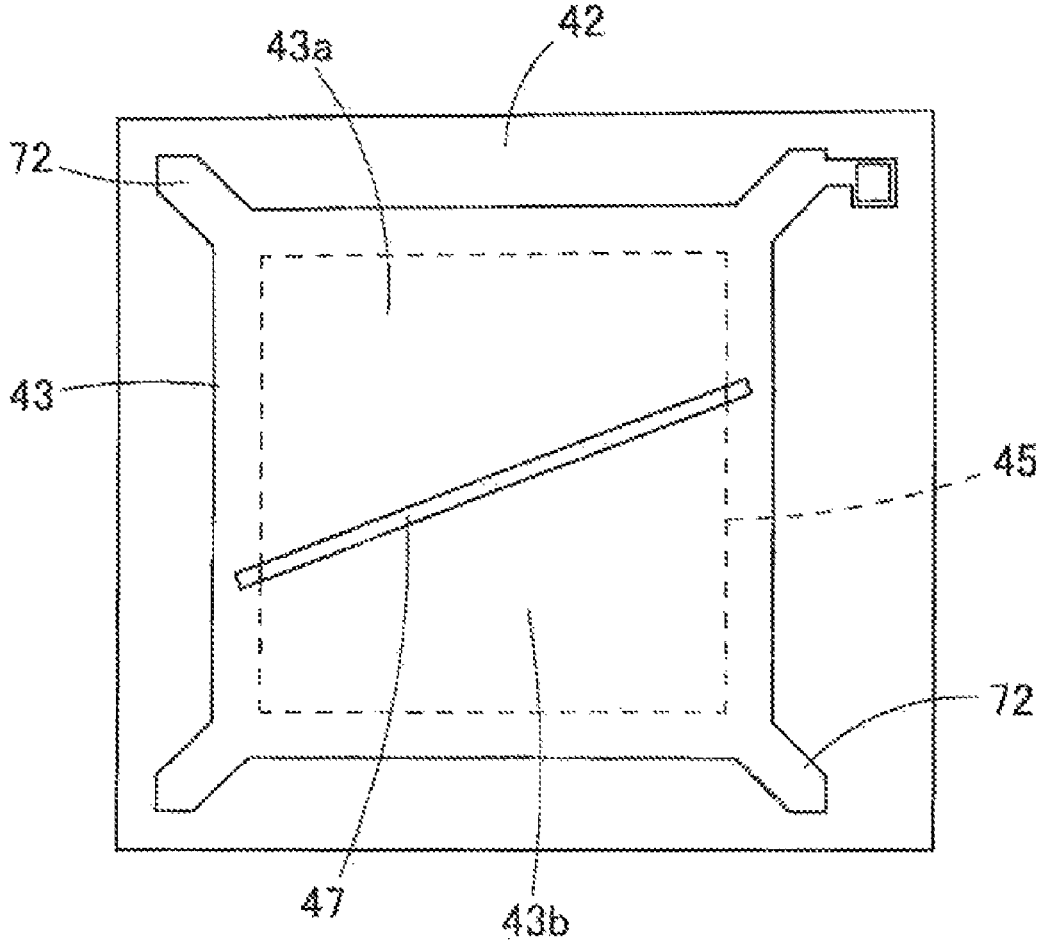
FIG. 22 is a plan view showing a different shape of a diaphragm in the acoustic sensor of Embodiment 6.

Further, as shown in FIG. 22, the slit 47 may be inclined from the diagonal direction of the diaphragm 43 or the direction parallel to the sides thereof.

As in FIGS. 21 and 22, the divided diaphragms 43*a*, 43*b* are supported in cantilever form when the direction of the slit 47 is not toward the fixed places of the diaphragm 43. This leads to an increase in displacement at the end of the slit 47, and stress concentration tends to occur at the end of the slit 47. When the stress concentration increases, the diaphragm 43 tends to be broken under the influence of the stress concentration. As opposed to this, when the slit 47 is oriented in the diagonal direction as in Embodiment 4, the displacement of the end of the slit 47 is small, and the stress concentration at the end of the slit 47 is thus small. Accordingly, although such arrangements of the slit 47 as in FIGS. 21 and 22 can be made, the slit 47 is desirably set in a direction in which the fixed places of the diaphragm 43 are connected as in Embodiment 4.

(Seventh Embodiment)

Figure 23:
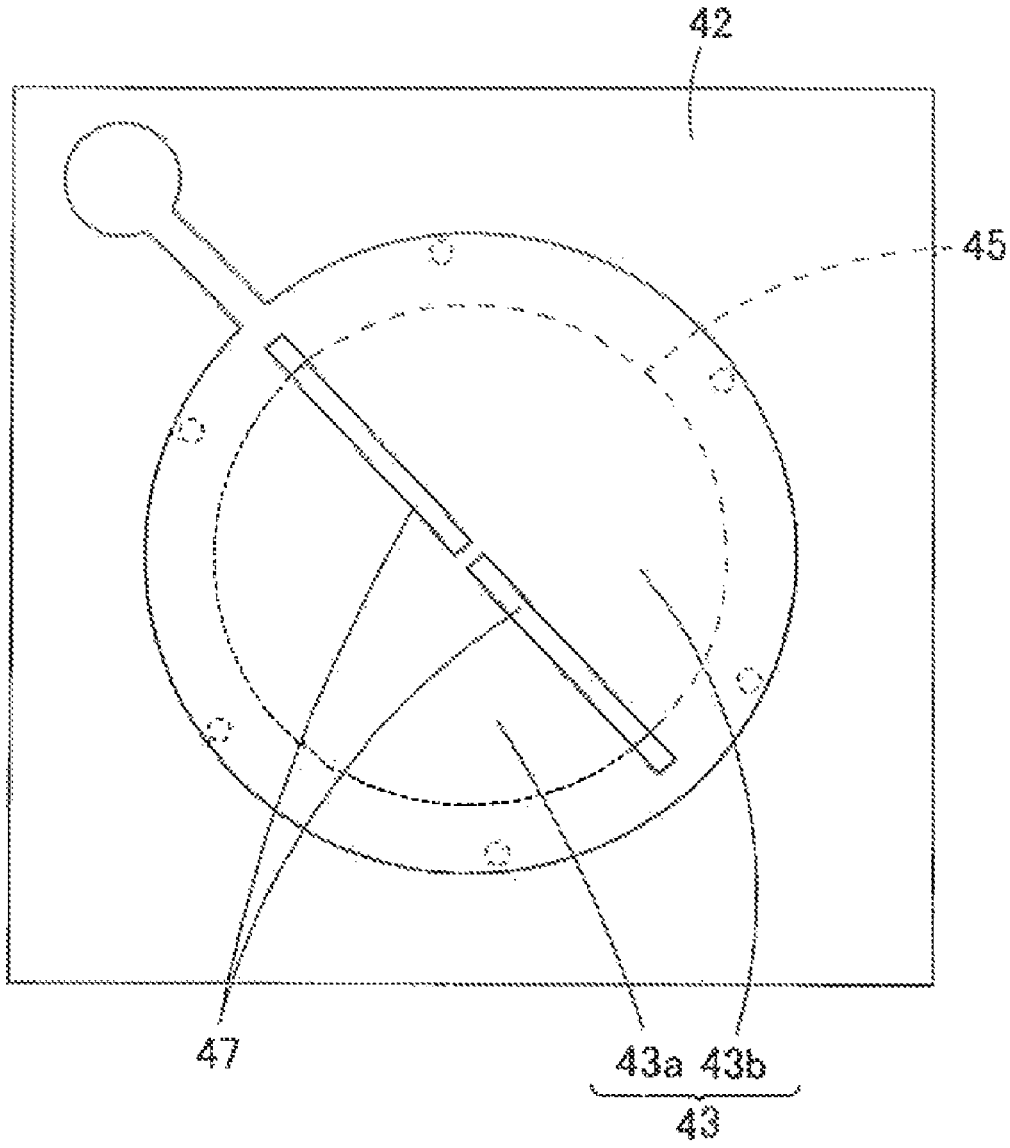
FIG. 23 is a plan view showing a shape of a diaphragm in the acoustic sensor according to Embodiment 7 of the present invention.

Each diaphragm formed on each side of the slit may pass through the slit so as to be connected to each other. For example, in an embodiment shown in FIG. 23, one slit 47 is partially interrupted and it is as if the two slits 47 are linearly arrayed. Therefore, the diaphragms 43*a*, 43*b* located on both sides of the slit 47 with the slit provided therebetween are partially connected to each other through the interrupted portion of the slit 47. There is no problem even with such a form so long as a length of the interrupted portion of the 47 is not excessively large.

(Eighth Embodiment)

Figure 24:
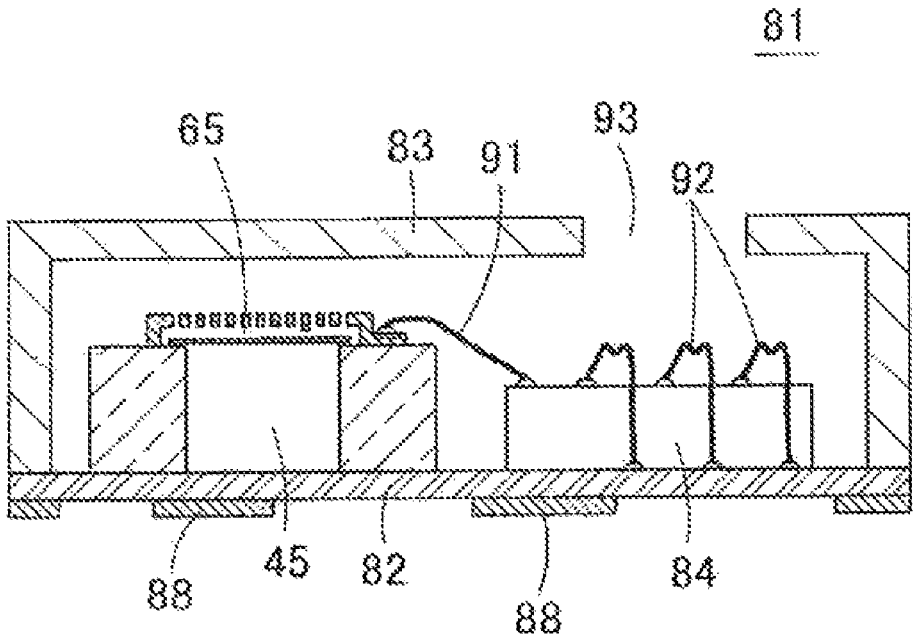
FIG. 24 is a sectional view of a microphone according to Embodiment 8 of the present invention.
Figure 25:
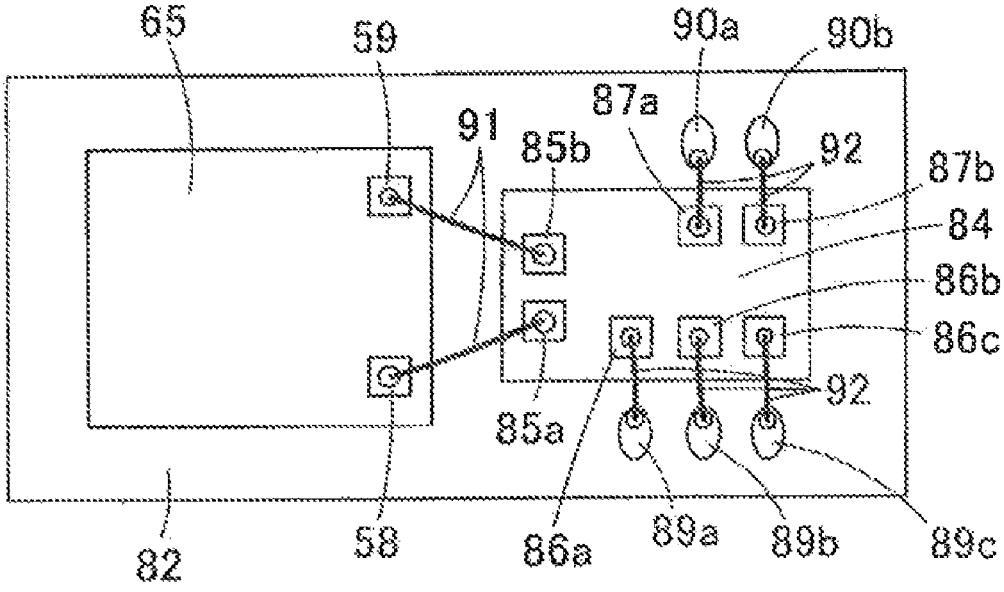
FIG. 25 is a plan view showing a state where a cover of the microphone of Embodiment 8 has been removed.

FIG. 24 is a sectional view of a MEMS microphone using an acoustic sensor of each of the above embodiments. FIG. 25 is a plan view of the microphone in a state where a cover has been removed.

This microphone 81 is one housing an acoustic sensor 65 and a signal processing circuit 84 (ASIC) inside a package made up of a circuit substrate 82 and a cover 83. The acoustic sensor 65 and the signal processing circuit 84 are mounted on the top surface of the circuit substrate 82. Electrode pads 58, 59 of the acoustic sensor 65 are respectively connected to pads 85*a*, 85*b* of the signal processing circuit 84 by bonding wires 91. A plurality of terminals 88 for electrically connecting the microphone 81 with the outside are provided on the under surface of the circuit substrate 82, and electrode sections 89*a* to 89*c*, 90*a*, 90*b*, which are conducted with the terminal 88, are provided on the top surface of the circuit substrate 82. Respective pads 86*a* to 86*c*, 87*a*, 87*b* of the signal processing circuit 84 mounted on the circuit substrate 82 are respectively connected to the electrode sections 89*a* to 89*c*, 90*a*, 90*b* by bonding wires 92. It is to be noted that the pad of the signal processing circuit 84 has a function of supplying power to the acoustic sensor 65, and a function of outputting a capacity change signal of the acoustic sensor 65 to the outside.

The cover 83 is attached to the top surface of the circuit substrate 82 so as to cover the acoustic sensor 65 and the signal processing circuit 84. A sound introduction port 93 for introducing an acoustic vibration into the package is opened on the top surface of the cover 83. Further, the package has a function of an electromagnetic shield, protecting the microphone 81 from electrical disturbance and mechanical shock from the outside.

Therefore, an acoustic vibration having entered the package through the sound introduction port 93 is detected by the acoustic sensor 65 and subjected to predetermined signal processing by the signal processing circuit 84, and is then outputted. Herein, with the acoustic sensor according to the present invention in use as the acoustic sensor 65, the microphone 81 with a high S/N ratio is formed.

Figure 26:
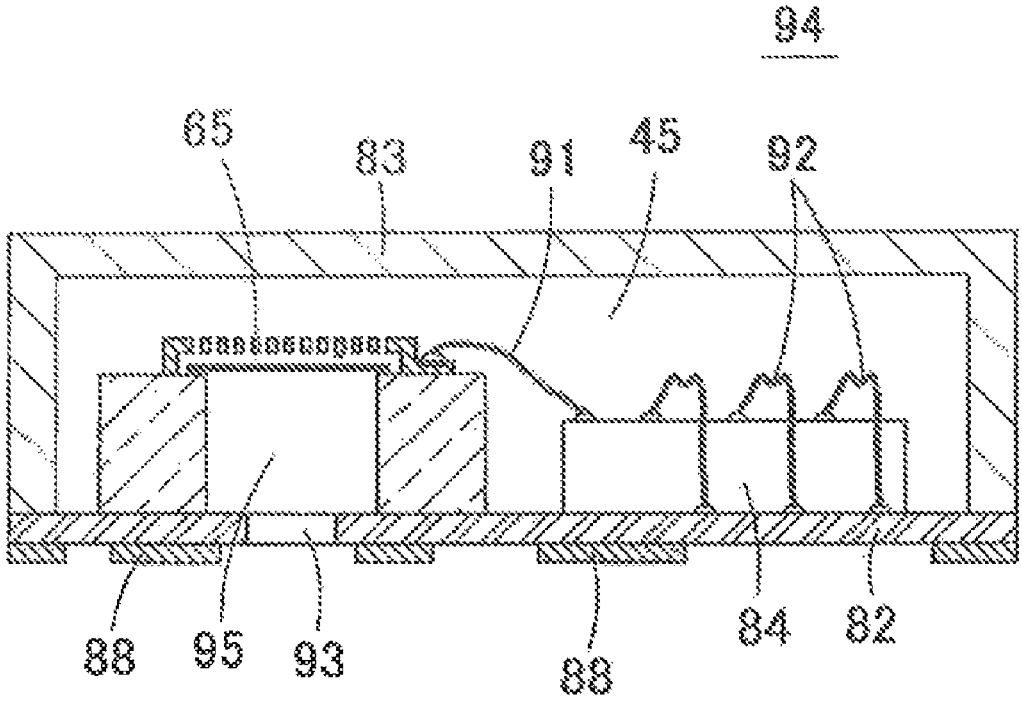
FIG. 26 is a sectional view showing a microphone with a different structure in Embodiment 8.

In addition, FIG. 26 shows a microphone 94 with a different structure. In this microphone 94, the sound introduction port 93 is opened not in the cover 83 but in the circuit substrate 82 in a position opposed to the under surface of the hollow section of the silicon substrate 42. In this microphone 94, with an acoustic vibration introduced through the sound introduction port 93 of the circuit substrate 82, the hollow section of the silicon substrate 42 serves as a front chamber 95, and the space inside the package serves as the back chamber 45. According to such a form, the volume of the back chamber 45 can be increased, so as to further improve the sensitivity of the microphone 81.

DESCRIPTION OF SYMBOLS

41, 61-65: acoustic sensor
42: silicon substrate
43*a*, 43*b*, 43*c*: diaphragm
44: canopy section
45: back chamber
46: anchor
47: slit
49: fixed electrode plate
50: air gap
52: vent hole
60*a*, 60*b*: acoustic sensing section
81, 94: microphone
82: circuit substrate
83: cover
84: signal processing circuit

The invention claimed is:

1. An acoustic sensor, comprising:
a substrate, having a hollow section;
a thin film-like diaphragm, arranged above the substrate so as to cover the hollow section;
a movable electrode plate, formed on the diaphragm;
a back plate, fixed to the top surface of the substrate so as to be opposed to the diaphragm; and
a fixed electrode plate, provided on the back plate in a position opposed to the movable electrode plate, wherein
the diaphragm and the movable electrode plate are substantially divided by a slit into a plurality of areas, and a plurality of parallelly connected capacitors are configured by the respective divided movable electrode plates and the fixed electrode plate.

2. The acoustic sensor according to claim 1, wherein the slit is formed in a position passing through a maximal displacement place of the diaphragm.

3. The acoustic sensor according to claim 1, wherein the respective areas of the diaphragm divided by the slit respectively have the maximal displacement places with the slit provided therebetween.

4. The acoustic sensor according to claim 1, wherein the slit is located on a line segment connecting any two supporting places out of supporting places of the diaphragm.

5. The acoustic sensor according to claim 1, wherein the slit is partially interrupted, and the respective areas of the diaphragm, which are located on both sides of the slit with the slit provided therebetween, are partially connected to each other through the interrupted portion of the slit.

6. The acoustic sensor according to claim 1, wherein a width of the slit is not larger than 10 μm.

7. The acoustic sensor according to claim 1, wherein a length of the slit is not smaller than a half of a distance across length of the diaphragm in an extending direction of the slit.

8. The acoustic sensor according to claim 1, wherein the diaphragm has a circular form.

9. The acoustic sensor according to claim 1, wherein the diaphragm has a rectangular form.

10. The acoustic sensor according to claim 1, wherein an edge of the diaphragm is supported by the substrate or the back plate at a plurality of supporting places, and a void is provided in at least one place between the adjacent supporting places out of the supporting places.

11. The acoustic sensor according to claim 1, wherein an acoustic vibration reaches the diaphragm through the hollow section.

12. A microphone, comprising:
an acoustic sensor according to claim 1; and
a circuit for processing a signal outputted from the acoustic sensor.

* * * * *